US011660888B2

(12) United States Patent
Hunter et al.

(10) Patent No.: US 11,660,888 B2
(45) Date of Patent: May 30, 2023

(54) DEVICES, SYSTEMS, AND METHODS FOR CONTROLLING AIRFLOW THROUGH VACUUM PLATEN OF PRINTING SYSTEMS VIA AIRFLOW ZONES

(71) Applicant: XEROX CORPORATION, Norwalk, CT (US)

(72) Inventors: Jonathan B. Hunter, Marion, NY (US); Jeffrey John Bradway, Rochester, NY (US); Joseph M. Ferrara, Jr., Webster, NY (US); Frank Berkelys Tamarez Gomez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/217,411

(22) Filed: Mar. 30, 2021

(65) Prior Publication Data

US 2022/0314664 A1 Oct. 6, 2022

(51) Int. Cl.
*B41J 2/01* (2006.01)
*B41J 13/22* (2006.01)
(Continued)

(52) U.S. Cl.
CPC ..... *B41J 13/226* (2013.01); *B41J 11/007* (2013.01); *B41J 11/0085* (2013.01); *B65H 5/222* (2013.01)

(58) Field of Classification Search
None
See application file for complete search history.

(56) References Cited

U.S. PATENT DOCUMENTS 8,388,246 B2 3/2013 Spence et al.
9,796,546 B1 10/2017 LeFevre et al.
9,815,303 B1 11/2017 Herrmann et al.
9,944,094 B1 4/2018 Herrmann et al.
(Continued)

FOREIGN PATENT DOCUMENTS

CN 104044366 A 9/2014
EP 1449668 A1 8/2004
(Continued)

OTHER PUBLICATIONS

Co-Pending Application U.S. Appl. No. 17/217,370, "Airflow Control Through Vacuum Platen of Printing System By a Movable Damper, and Related Devices, Systems, and Methods,", filed Mar. 30, 2021.
Co-Pending Application U.S. Appl. No. 17/217,388, "Airflow Control in a Printing System Using a Movable Baffle, and Related Devices, Systems, and Methods,", filed Mar. 30, 2021.
(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises printheads to eject ink to a deposition region. Print media are held by vacuum suction against a movable support surface, which moves over a vacuum platen. The vacuum platen comprises platen holes through which the vacuum suction is communicated. An airflow control system comprises airflow zones, each comprising a group of the platen holes, a duct, and a valve, the duct and the valve being arranged to selectively control vacuum suction through the group of the platen holes. For each of the printheads, at least one of the airflow zones is located under the respective printhead. Thus, airflow through platen holes under the printheads can be selectively
(Continued)

controlled by selectively controlling the vacuum suction in the airflow zones.

24 Claims, 16 Drawing Sheets

(51) Int. Cl.
*B65H 5/22* (2006.01)
*B41J 11/00* (2006.01)

(56) References Cited

U.S. PATENT DOCUMENTS

| | | | | |
|---|---|---|---|---|
| 10,688,778 | B2 | 6/2020 | Fromm et al. | |
| 2002/0158937 | A1 | 10/2002 | Pietrzyk et al. | |
| 2010/0208018 | A1 | 8/2010 | Snyder et al. | |
| 2010/0276868 | A1 | 11/2010 | Moore et al. | |
| 2011/0248441 | A1 | 10/2011 | Yamada | |
| 2013/0050375 | A1 | 2/2013 | Ishimori et al. | |
| 2016/0347091 | A1* | 12/2016 | Onuma | B41J 11/06 |
| 2018/0339529 | A1 | 11/2018 | Zirilli | |
| 2020/0345545 | A1 | 11/2020 | Zhang | |
| 2021/0138803 | A1* | 5/2021 | Lefevre | B41J 11/0085 |

FOREIGN PATENT DOCUMENTS

| | | | |
|---|---|---|---|
| EP | 1449668 | B1 | 5/2007 |
| EP | 1 319 510 | B1 | 9/2009 |
| GB | 2 374 834 | A | 10/2002 |

OTHER PUBLICATIONS

Co-Pending Application U.S. Appl. No. 17/217,399, "Devices, Systems, and Methods for Controlling Airflow Through Vacuum Platen of Printing System By a Movable Damper,", filed Mar. 30, 2021.

Co-Pending Application U.S. Appl. No. 17/217,432, "Controlling Airflow Through Vacuum Platen of Printing System by a Movable Damper, and Related Devices, Systems, and Methods,", filed Mar. 30, 2021.

Co-Pending Application U.S. Appl. No. 17/217,448, "Devices, Systems, and Methods for Controlling Airflow Through Vacuum Platen of Printing System by Rotating Valve,", filed Mar. 30, 2021.

Co-Pending Application U.S. Appl. No. 17/217,466, "Airflow Control in a Printing System, and Related Devices, Systems, and Methods,", filed Mar. 30, 2021.

* cited by examiner

DEVICES, SYSTEMS, AND METHODS FOR CONTROLLING AIRFLOW THROUGH VACUUM PLATEN OF PRINTING SYSTEMS VIA AIRFLOW ZONES

FIELD

Aspects of this disclosure relate generally to inkjet printing, and more specifically to inkjet printing systems having a media transport device utilizing vacuum suction to hold and transport print media. Related devices, systems, and methods also are disclosed.

INTRODUCTION

In some applications, inkjet printing systems use an ink deposition assembly with one or more printheads, and a media transport device to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport device utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the moving surface opposite from the side that supports the print media. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include a media transport device utilizing vacuum suction is unintended blurring of images resulting from air currents induced by the vacuum suction. In some systems, such blurring may occur in portions of the printed image that are near the edges of the print media. This blurring may occur due to uncovered holes in the media transport device adjacent to one or more of the edges of the print media. In particular, during a print job, the print media are spaced apart from one another on the movable support surface as they are transported through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface. Moreover, to ensure adequate hold down force is applied to all sizes of print media the system is designed to use, the holes for vacuum suction are generally distributed across a given region of the movable support surface that has a dimension in the cross-process direction that is close to a dimension in the cross-process direction of the largest size of print media that the system is designed to use. As a result of this, if the print medium currently being printed is smaller in the cross-process direction than the largest size, the print medium may not extend across the full width of the region containing the holes, and therefore a group of holes along and adjacent to the inboard edge of the print medium will be uncovered. (As described further below, the "inboard" edge of the print medium is defined herein as the edge that is opposite from the edge that is used to register the print media in the cross-process direction, which is defined as the "outboard" edge; registration schemes may vary from system to system, and therefore the edge that is the "inboard" edge, as used herein, may vary from system to system.) Because various holes near the lead, trail, and inboard edges are not covered, as described above, the vacuum of the vacuum plenum induces air to flow through those uncovered holes. This airflow around the lead, trail, and inboard edges may deflect ink droplets as they are traveling from a printhead to the substrate, and thus cause blurring of the images that are being printed near those edges.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly, a media transport device, and an airflow control system. The ink deposition assembly comprises one or more printheads arranged to eject ink to a deposition region of the ink deposition assembly. The media transport device comprises a vacuum platen comprising a plurality of platen holes, and a movable support surface configured to support the print medium and movable along a process direction through the deposition region. The media transport device is configured to hold the print medium against the movable support surface by vacuum suction communicated to the movable support surface through the platen holes in the vacuum platen. The airflow control system comprises a plurality of airflow zones. Each of the airflow zones comprises a group of the platen holes, a duct, and a valve, the duct and the valve being arranged to selectively control vacuum suction through the group of the platen holes. For each of the printheads, at least one of the plurality of airflow zones is located under the respective printhead.

In accordance with at least one embodiment of the present disclosure, a method comprises transporting a print medium through a deposition region of a printhead of a printing system and ejecting print fluid from the printhead to deposit the ink to the print medium in the deposition region. The print medium is held during the transporting against a movable support surface of a media transport device via vacuum suction communicated to the movable support surface through platen holes in a vacuum platen. The printing system comprises airflow zones that each comprise a corresponding group of the platen holes. The method further comprises selectively controlling suction through a first group of airflow zones, comprising one or more of the airflow zones, based on the size of the print medium, and selectively controlling suction through a second group of airflow zones, comprising one or more of the airflow zones, based on the size of the print medium.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

In the Figures and the description herein, numerical indexes such as "_1", "_2", etc. are appended to the end of the reference numbers of some components. When there are multiple similar components and it is desired to refer to a specific one of those components, the same base reference number is used and different indexes are appended to it to distinguish individual components. However, when the components are being referred to generally or collectively without a need to distinguish between specific ones, the index may be omitted from the base reference number. Thus, as one example, a print medium 5 may be labeled and referred to as a first print medium 5_1 when it is desired to identify a specific one of the print media 5, as in FIG. 1A, but it may also be labeled and referred to as simply a print medium 5 in other cases in which it is not desired to distinguish between multiple print media 5.

Figure 1A:
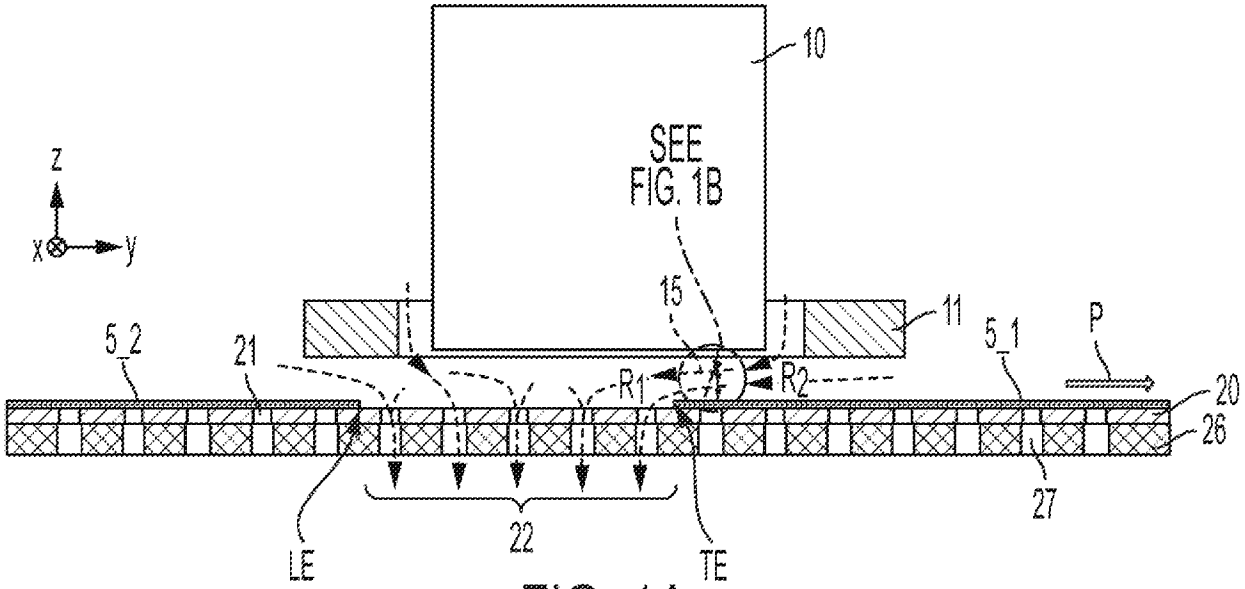
FIG. 1A RELATED ART
FIGS. 1A-1L schematically illustrate air flow patterns relative to a printhead assembly, transport device, and print media during differing stages of print media transport through an ink deposition region of a conventional inkjet printing system, and resulting blur effects in the printed media product.
Figure 1C:
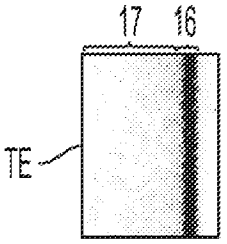

As described above, when an inter-media zone is near or under a printhead, the uncovered holes in the inter-media zone can create crossflows that can blow satellite droplets off course and cause image blur. Similarly, uncovered holes along an inboard or outboard side of the print media can also create crossflows that cause image blur. To better illustrate some of the phenomena occurring giving rise to the blurring issues, reference is made to FIGS. 1A-1F. FIGS. 1A, 1D, 1G, and 1J illustrate schematically printheads 10 printing on a print medium 5 near a trail edge TE, a lead edge LE, an inboard edge, and a middle, respectively, of the print medium 5. FIGS. 1A, 1D, and 1J are cross-sections taken through a printhead 10 along a process direction (y-axis direction in the figures), while FIG. 1G is a cross-section taken through the same printhead 10 along a cross-process direction perpendicular to the process direction (x-axis direction in the figures), with the illustration in FIG. 1G depicting an embodiment having three printheads in a series along the x-direction with one being offset from the other two. FIGS. 1B, 1E, 1H, and 1K illustrate enlarged views of the regions A, B, C, and D respectively in FIGS. 1A, AD, 1B, and 1J. FIGS. 1C, 1F, 1I and 1L illustrate enlarged pictures of printed images, the printed images comprising lines printed near the trail edge TE, lead edge LE, inboard edge, and middle, respectively, of a sheet of paper.

As shown in FIGS. 1A, 1D, 1G, and 1J, the inkjet printing system comprises one or more printheads 10 to eject ink to print media 5 through printhead openings 19 in a carrier plate 11. The inkjet printing system also comprises a movable support surface 20 to transport the print media 5 in a process direction P, which corresponds to a positive y-axis direction in the Figures. The movable support surface 20 slides along a top of a vacuum platen 26, and a vacuum environment is provided on a bottom side of the platen 26. The movable support surface 20 has holes 21 and the vacuum platen 26 has platen holes 27. The holes 21 and 27 periodically align as the movable support surface 20 moves thereby exposing the region above the movable support surface 20 to the vacuum below the platen 26. In regions where the print medium 5 covers the holes 21, the vacuum suction through the aligned holes 21 and 27 generates a force that holds the print medium 5 against the movable support surface 20. However, little or no air is drawn into these covered holes 21 and 27 from the environment above the movable support surface 20 since they are blocked by the print medium 5. On the other hand, as shown in FIGS. 1A, 1D, and 1G in the inter-media zone 22 (see FIGS. 1A and 1D) and in the uncovered region 24 near the inboard side IB of the platen 26 (see FIG. 1G), the holes 21 and 27 are not covered by the print media 5, and therefore the vacuum suction pulls air from above the movable support surface 20 to flow down through these holes 21 and 27. This creates airflows, indicated by the dashed arrows in FIGS. 1A, 1D, and 1G which flow from regions around the printhead 10 towards the uncovered holes 21 and 27 in the inter-media zone 22 and the uncovered region 24, with some of the airflows passing under the printhead 10.

In FIG. 1A, the print medium 5_1 is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P). Accordingly, some of the air being sucked towards the inter-media zone 22 will flow upstream through the ink-ejection region under the printhead 10. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through a portion of the ink-ejection region (e.g., region A in FIG. 1A)

which is between the regions $R_1$ and $R_2$. Airflows such as these, which cross through the ink-ejection region, are referred to herein as crossflows 15. In FIG. 1A, the crossflows 15 flow upstream, but in other situations the crossflows 15 may flow in different directions.

Figure 1B:
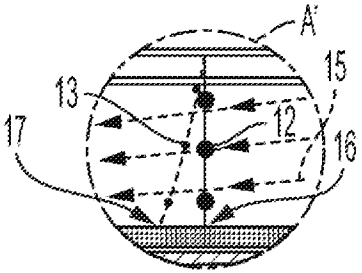
Figure 1D:
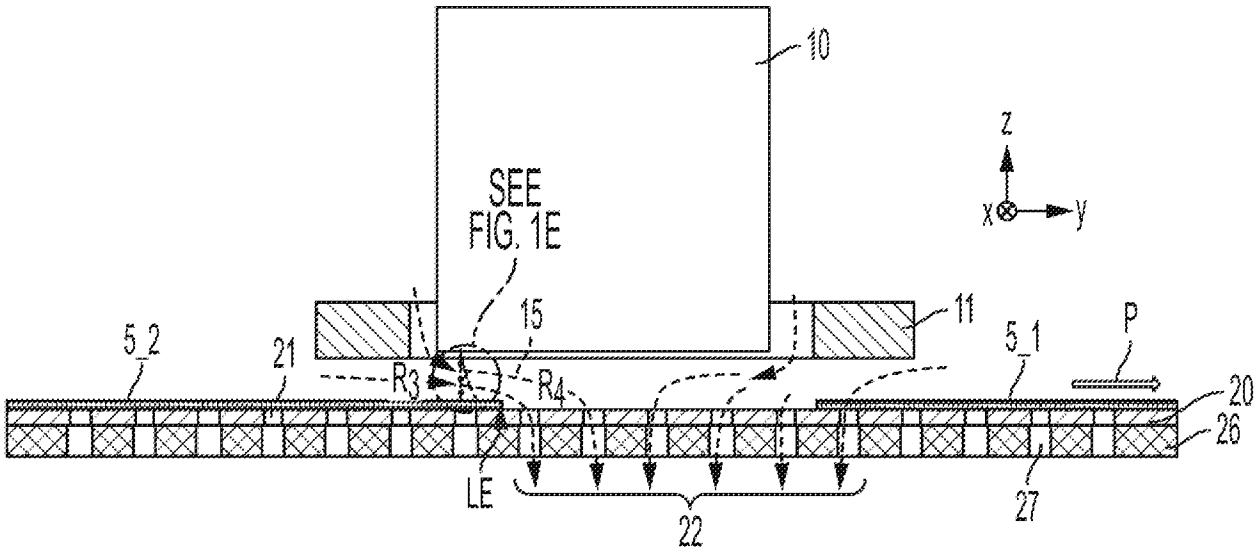
FIG. 1D RELATED ART

As shown in the enlarged view A' in FIG. 1B, which comprises an enlarged view of the region A in FIG. 1A, as ink is ejected from the printhead 10 towards the medium 5, main droplets 12 and satellite droplets 13 are formed. The satellite droplets 13 are much smaller than the main droplets 12 and have less mass and momentum, and thus the upstream crossflows 15 tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. The result of such crossflows and consequent misplaced droplets can be seen in an actual printed image in FIG. 1C, in which a region 16' of denser printed dots corresponding to the intended printed line is formed by droplets (e.g., generally the main droplets 12) which were deposited predominantly at their intended locations, whereas a region 17' of sparser dots dispersed away from the line are formed by droplets (e.g., generally the satellite droplets 13) which were blown away from the intended locations to land in unintended locations. The resulting image has a blurred or smudged appearance for the printed line. Notably, the blurring in FIG. 1C is asymmetrically biased towards the trail edge TE, which would be the expected result of the crossflows 15 near the trail edge TE blowing primarily in an upstream direction. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

Figure 1F:
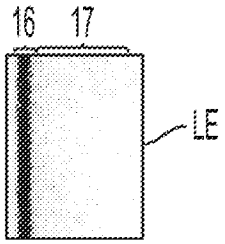
Figure 1E:
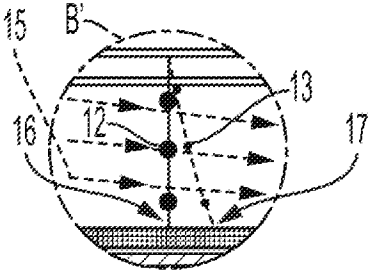
Figure 1G:
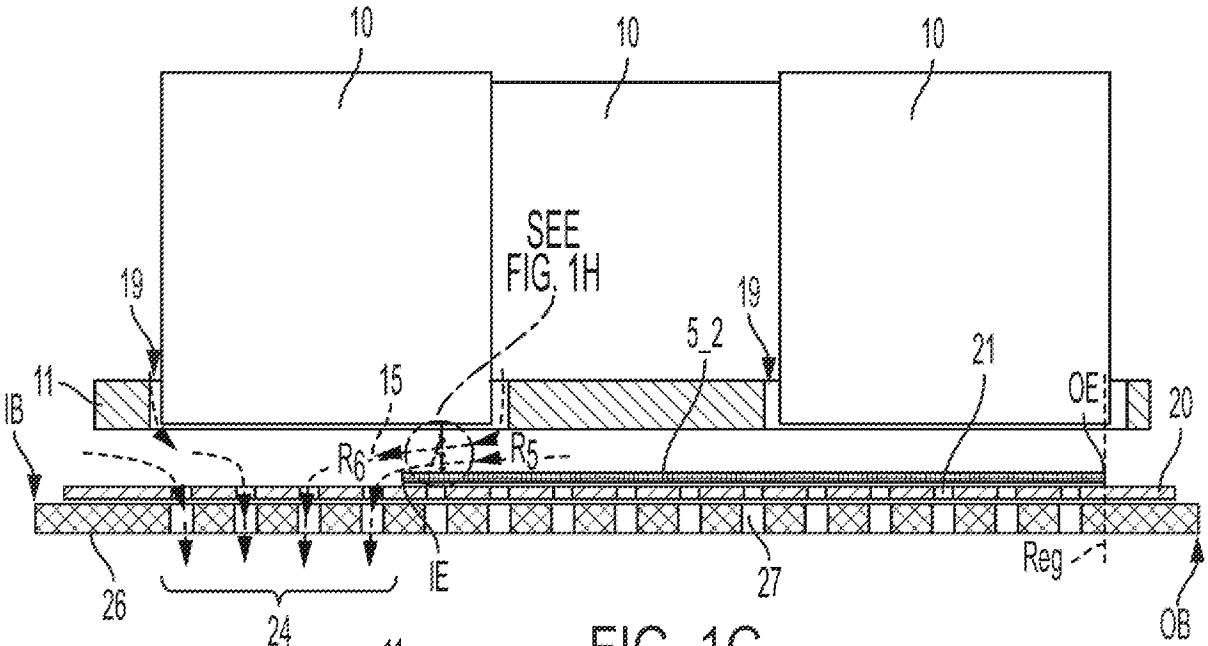
FIG. 1G RELATED ART

FIGS. 1D-1F schematically illustrate another situation in which such blurring occurs, but this time near the lead edge LE of the print medium 5_2. The cause of blurring near the lead edge LE is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream to region $R_4$. Thus, as shown in the enlarged view B' of FIG. 1E, which comprises an enlarged view of the region B of FIG. 1D, in the case of printing near the lead edge LE of the print medium 5_2, the satellite droplets 13 are blown downstream towards the lead edge LE of the print medium 5_2 (positive y-axis direction) to land at unintended locations 17, while the main droplets 12 tend to land at or near their intended locations 16. As shown in FIG. 1F, such an effect results in asymmetric blurring that is biased towards the lead edge LE of the print medium (i.e., a denser region 16' of printed dots corresponding to a line is formed with a sparser region 17' of printed dots trailing away from the line toward the lead edge LE).

Figure 1I:
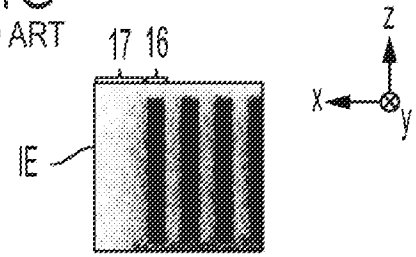
Figure 1H:
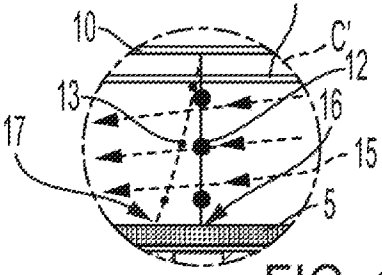
Figure 1J:
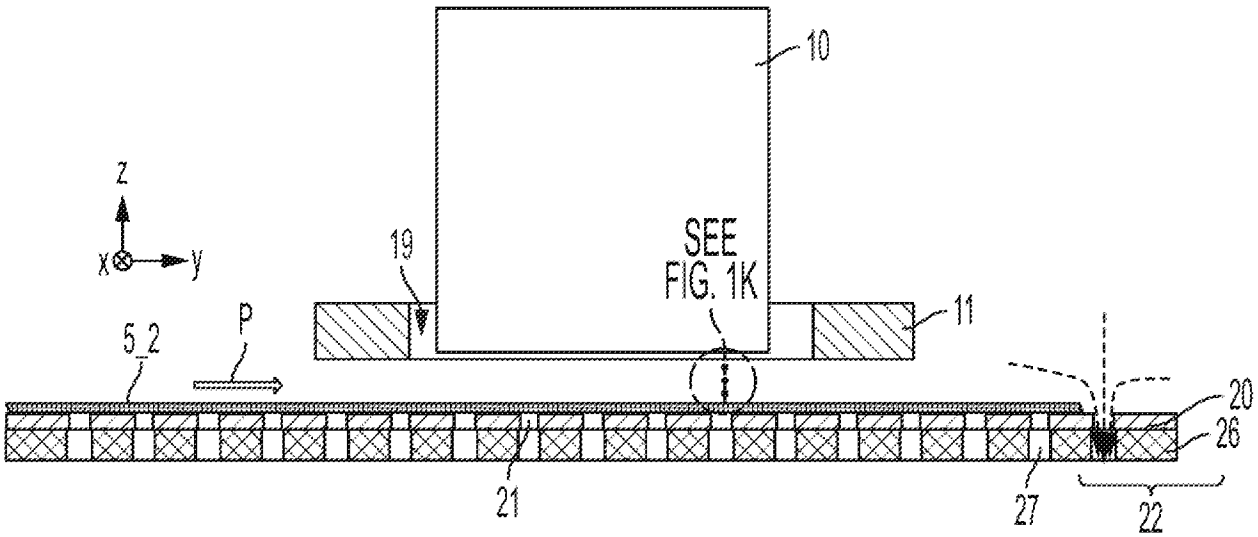
FIG. 1J RELATED ART

FIGS. 1G-1I illustrate yet another situation in which such blurring can occur, but this time near the inboard edge IE of the print medium 5 due to uncovered holes 21, 27 in that region. The cause of blurring near the inboard edge IE is similar to that described above in relation to the trail edge TE and lead edge LE, except that in the case of printing near the inboard edge IE the ink-ejection region is now located outboard of the uncovered region 24 of the holes 21 and 27 in the movable support surface 20 and platen 26. As a result, the crossflows 15 that are crossing through the ink-ejection region now originate from the outboard side of the printhead 10, e.g., from region $R_5$, and flow in an inboard direction towards the region $R_6$. Thus, as shown in the enlarged view C' of FIG. 1H, which comprises an enlarged view of the region C of FIG. 1G, in the case of printing near the inboard edge IE, the satellite droplets 13 are blown inboard towards the inboard edge IE of the print medium 5 (positive y-axis direction) and land at unintended locations 17 rather than at the intended location 16 where main droplets 12 land. As shown in FIG. 1I, such a crossflow pattern is expected to result in asymmetric blurring that is biased towards the inboard edge IE (i.e., a denser region 16' of printed dots corresponding to a line is formed with a sparser region 17' of printed dots trailing away from the line toward the inboard edge IE).

Figure 1L:
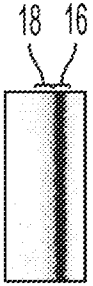
Figure 1K:
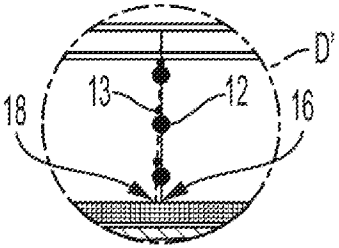

In contrast, as shown in FIG. 1J and the enlarged view D' in FIG. 1K, which corresponds to an enlarged view of region D of FIG. 1J, when printing farther from the edges (trail, leading, or inboard) of the print medium 105 there may be little or no crossflows 15 because the inter-media zone 22 and the uncovered region 24 are too distant to induce much airflow. Because the crossflows 15 are absent or weak farther away from the edges of the print medium 5, the satellite droplets 13 in this region are not as likely to be blown off course. Thus, as shown in FIGS. 1K and 1L, when printing farther from the edges of the print medium 5, the satellite droplets land at the intended location 16 or at locations 18 that are much closer to the intended locations 16 resulting in much less image blurring. The deposition locations 18 of the satellite droplets may still vary somewhat from the intended locations 16, due to other factors affecting the satellite droplets 13, but the deviation is smaller than it would be near the lead or trail edges. FIG. 1L depicts a resulting image of a situation such as that in FIGS. 1J and 1K, showing the printed line presenting droplets landing at intended locations 16' in which and some droplets landing sufficiently close to the intended locations 16' at locations 18'. The resulting image does not show a significantly noticeable blurring or smudged appearance of the line.

Embodiments disclosed herein may, among other things, reduce or eliminate such image blur by utilizing an airflow control system that reduces or eliminates the crossflows. With the crossflows reduced or eliminated, droplets, including satellite droplets, are more likely to land closer to or at their intended deposition locations, and therefore the amount of blur is reduced. Airflow control systems in accordance with various embodiments reduce or eliminate the crossflows by providing a number of discrete airflow zones in the vacuum plenum at locations near the printheads and selectively turning on and off the airflow zones. Each airflow zone comprises a group of the platen holes in the vacuum platen, a duct arranged to control airflow through the corresponding group of platen holes, and a valve to control airflow through the duct. The duct is arranged on the side of the vacuum platen that faces the interior of the vacuum plenum and defines a conduit or passageway to communicate the vacuum suction of the vacuum plenum to the corresponding group of platen holes. When a given airflow zone is "on," as used herein, its valve is open such that the interior of the vacuum plenum is in fluidic communication with the corresponding group of holes via the duct, thus allowing vacuum suction through the corresponding group of holes. When the given airflow zone is "off," as used herein, the associated valve is closed and the interior of the vacuum plenum is not in fluidic communication with the corresponding group of holes, thus preventing vacuum suction through the corresponding group of holes. Embodiments of the present disclosure contemplate selectively turning airflow zones on and off based on the location of the inter-media zone. More specifically, at any given time, any airflow zones that are currently under the inter-media zone are off, while other airflow zones are on. Because the airflow zones under the inter-media zone are off, vacuum suction through the uncovered holes of the inter-media zone does not occur. Thus, the inter-media zone is prevented from inducing crossflows, and therefore the edge blur that would otherwise be caused by these crossflows is reduced or eliminated. Because the other airflow zones (those under the print media and not under the inter-media zones) are on and the holes associated with those zones covered by a print medium, vacuum suction is communicated through the corresponding groups of holes to the print medium, thus applying hold down force to the print medium. In addition, airflow zones along an inboard edge of the media transport device that are not covered by the print media currently being used due to the size of the print media can be turned off. This prevents suction through the uncovered holes along the inboard edge. Thus, the uncovered region along the inboard side of the media transport device is prevented from inducing crossflows (or the crossflows are reduced), and therefore the image blur that would otherwise occur along the inboard edge due to these crossflows is reduced.

Figure 2:
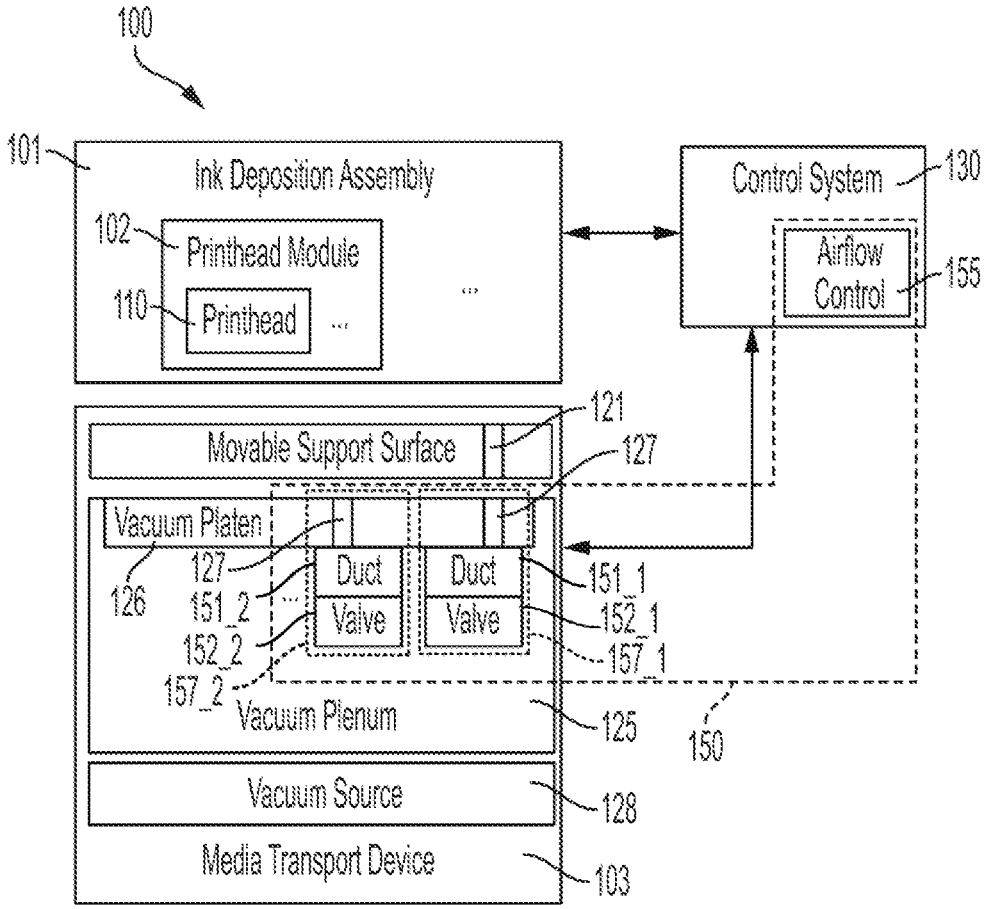
FIG. 2 is a block diagram illustrating components of an embodiment of an inkjet printing system including an air flow control system.

Turning now to FIG. 2, an embodiment of a printing system will be described in greater detail. FIG. 2 is a block diagram which schematically illustrates a printing system 100 utilizing the above-described airflow control system. The printing system 100 comprises an ink deposition assembly 101 to deposit ink on print media, a media transport assembly 103 to transport print media through the ink deposition assembly 101, and a control system 130 to control operations of the printing system 100. These components of the printing system 100 are described in greater detail in turn below. In addition, various components of the printing system 100 participate in controlling airflow around the printheads, and thus these parts may be referred to collectively as an airflow control system 150.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be a carrier plate, as described in more detail below with regard to FIG. 3. The carrier plate may comprise printhead openings, and the printheads 110 are arranged to eject their ink through the printhead openings. In some embodiments, the carrier plate supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections, and so on, as known in the art.

As shown in FIG. 2, the media transport device 103 comprises a movable support surface 120, a vacuum plenum 125, a vacuum source 128, and a number of airflow zones 157 (e.g., airflow zones 157_1, 157_2). Each of the airflow zones 157 comprises a group of platen holes 127, a duct 151 (e.g., ducts 151_1 and 151_2), and a valve 152 coupled to the duct 151 (e.g., valves 152_1, 152_2). In FIG. 2 two airflow zones 157 are illustrated, but other numbers can be used depending on a variety of factors as will become apparent from the descriptions of the embodiments of FIGS. 5 and 6 below. The movable support surface 120 transports the print media through a deposition region of the printing assembly 101. The vacuum plenum 125 supplies vacuum suction to one side of the movable support surface 120 (e.g., a bottom side), and print media is supported on an opposite side of the movable support surface 120 (e.g., a top side). Air holes 121 through the movable support surface 120 communicate the vacuum suction through the surface 120, such that the vacuum suction holds down the print media against the surface 120. The movable support surface 120 is movable relative to the printing assembly 101, and thus the print media held against the movable support surface 120 is transported relative to the printing assembly 101 as the movable support surface 120 moves. Specifically, the movable support surface 120 transports the print media through a deposition region of the printing assembly 101, the deposition region being a region in which print fluid (e.g., ink) is ejected onto the print media, such as a region under the printhead(s) 110. The movable support surface 120 can comprise any structure capable of being driven to move relative to the printing assembly 101 and which has holes 121 to allow the vacuum suction to be communicated to hold down the print media. Such structures of movable support surfaces that are contemplated as within the scope of the disclosure include, but are not limited to, for example a belt, one or more rotatable drums, etc. Those having ordinary skill in the art are familiar with various movable support structures used in printing systems to convey the print media.

The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. In some embodiments, the movable support surface 120 is supported by a vacuum platen 126, which may be a top wall of the vacuum plenum 125. In such an embodiment, the movable support surface 120 is fluidically coupled to the vacuum in the plenum 125 via platen holes 127 through the vacuum platen 126. In some embodiments, the movable support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

As noted above, each airflow zone 157 comprises a duct 151. The ducts 151 are provided within the vacuum plenum 125 on the side of the vacuum platen 126 and/or the movable support surface 120 that faces the interior of the vacuum plenum 125. Each duct 151 comprises baffles or other structures that define a conduit or passageway to communicate the vacuum suction of the vacuum plenum 125 to a corresponding group of platen holes 127 in the vacuum platen 126. Each duct 151 surrounds (fences in) a corresponding group of the platen holes 127, such that the vacuum suction from the vacuum plenum 125 must be communicated through the respective duct 151 in order to be communicated to its corresponding group of platen holes 127. Each duct 151 has an opening that can allow the coupling of the interior of the respective duct 151 with the rest of the vacuum plenum 125.

As described above, each airflow zone 157 also has a valve 152. Each valve 152 is positioned relative to the opening in the corresponding duct 151 such that when the respective valve 152 is open the interior of the corresponding duct 151 is communicably coupled to the rest of the vacuum plenum 125 and when the respective valve 152 is closed the interior of the corresponding duct 151 is not communicably coupled to (e.g., sealed off from) the rest of the vacuum plenum 125. Thus, when a given valve 152 is open, the vacuum suction from the vacuum plenum 125 is communicated through the corresponding duct 151 to the corresponding group of platen holes 127, and when the given valve 152 is closed the vacuum suction is not communicated through the corresponding duct 151 to the corresponding group of platen holes 127. The state of an airflow zone 157 in which its corresponding valve 152 is open and vacuum suction is allowed through the corresponding platen holes 127 is referred to herein as the airflow zone 157 being "on." The state of an airflow zone 157 in which its corresponding valve 152 is closed and vacuum suction is prevented through the corresponding platen holes 127 is referred to herein as the airflow zone 157 being "off."

In an embodiment, the valves 152 comprise rotary valves movable between open and closed states by rotating a valve body of the valve 152. The valves 152 may be operably coupled to one or more actuators (not illustrated) which actuate the valves 152 between the open and closed states. The actuator may be any device capable of imparting force/motion to the valves to actuate them between the open and closed states, such as an electronic motor, a pneumatic or hydraulic actuator, a solenoid, etc. The actuators may be part of the valves 152, or they may be separate from the valves. In some embodiments, each valve 152 has its own actuator. In other embodiments, multiple valves 152 may share the same actuator. For example, multiple rotary valves 152 may be ganged to the same drive shaft, which is driven by a single actuator. Those having ordinary skill in the art are familiar with such rotary valves and actuators that can be used to actuate them between open and closed states.

The airflow zones 157 may be arranged at locations where it is desired to control airflow through the vacuum platen 126. For example, in some embodiments at least some of the airflow zone 157 are provided at locations that are near (e.g., under) printheads 110, to allow the airflow zones 157 to control suction around the printheads 110. Such airflow zone 157 may be used to mitigate lead edge blur and trail edge blur as described above. In particular, such airflow zones 157 may be controlled to turn on and off based on the locations of print media (i.e., based on the locations of inter-media zones) relative to the respective airflow zones 157. In some embodiments, the airflow zones 157 collectively cover at least all of the areas directly below all of the printheads 110. When an airflow zone 157 is positioned (at least partially) below a printhead 110, the airflow zone 157 may be referred to herein as corresponding to the printhead 110.

As another example, in some embodiments at least some of the airflow zones 157 are positioned inboard of one or more of the printheads 110. These airflow zones 157 may be sued to mitigate inboard edge blur, as described above. More specifically, in embodiments in which an edge of a print medium is registered to one side of the media transport device 103 (this form of registration is referred to herein as an "edge registration scheme"), an uncovered region appears inboard of the print media when smaller print media are used, as described above, and therefore in such embodiments some of the airflow zones 157 may be provided on an inboard side of the printheads 110 to mitigate the inboard edge blur that is caused by such uncovered regions. It is possible for other registration schemes to be used besides an edge registration scheme. For example, a print medium could be centered on the movable support surface. Thus, in embodiments in which an edge registration scheme is not used, airflow zones 157 may be provided at locations where the uncovered regions are expected to appear when smaller print media are used in view of the type of registration scheme that is used in that system. For example, in embodiments in which the print media is centered on the movable support surface, uncovered regions will appear adjacent to both lateral sides of the print media when smaller print media are used and therefore airflow zones 157 may be provided on both lateral sides of the media transport device 103. Herein, it is assumed for convenience of discussion that an edge registration scheme is used, but it should be understood that everything said herein applies equally to systems in which other registration schemes are used, except that locations of some of the airflow zones 157 may be altered accordingly as described above.

In some embodiments, some of the airflow zones 157 that are located under a printhead 110 may be used both for mitigating lead/trail edge blur and also for mitigating inboard edge blur. For example, if the print medium being used is large enough to cover a particular airflow zones 157, then the airflow zones 157 may be turned on and off based on the position of the inter-media zone to mitigate lead/trail edge blur. But if a smaller print medium were used such that the same airflow zones 157 is not covered by the print medium, then the airflow zone 157 may be turned off throughout printing of that smaller size print medium regardless of the location of the inter-media zone to mitigate inboard edge blur.

The sizes and locations of the airflow zones 157 may vary from one system to the next. In some embodiments, it may be beneficial for the airflow zones 157 to provide for controlling airflow independently around individual printheads, and thus in some embodiments airflow zones 157 that are positioned under printheads 110 have a width in the process direction that allows each printhead 110 to have its own corresponding set of airflow zones 157, such as a width that is at most a little longer than a width of the printheads 110 in the process direction. The shorter the airflow zones 157 are in the process direction, the more fine-grained control may be had over airflow near the printheads 110. However, the smaller the airflow zones 157 are, the more complicated and/or costly the system may become to manufacture and control, as smaller airflow zones 157 may require smaller valves 152 and actuators and also more numerous valves 152. A person of ordinary skill in the art would understand that they can select a size for the airflow zones 157 for a particular printing system by balancing a desired granularity of control over airflow against other design goals and constraints for that system, such as the cost and availability of the valves 152 and actuators of various sizes. In some embodiments, each airflow zones 157 may have a width in the process direction corresponding to one row of holes 127, such that suction through individual rows of holes 127 can be controlled independently by selectively turning on or off the corresponding airflow zones 157. In some embodiments, each airflow zones 157 may have a width in the process direction corresponding to a group of multiple rows of platen holes 127. In some embodiments, each airflow zones 157 may have a width in the process direction approximately equal to a width of a printhead.

The length of the airflow zones 157 in the cross-process direction may also vary from system to system, and also from airflow zone 157 to airflow zone 157 within the same system. For airflow zones 157 that are intended to mitigate lead/trail edge blur but are not intended to mitigate inboard edge blur, the length in the cross-process direction does not generally affect their ability to perform their intended function, and thus any length may be selected based on what is convenient in the given system. For example, the length of these airflow zones 157 may be selected based on the size of selected valves 152 and/or the number of holes 127 that can be supplied with sufficient suction given the impedance of the selected valve 152. For example, if a given valve 152 has a particular impedance that would allow it to supply adequate suction to no more than n platen holes 127 (where n is an arbitrary integer number), then the lengths of the airflow zones 157 in the cross-process direction may be selected, in view of the length in the process direction, such that no more than n platen holes 127 are included in each airflow zone 157. In some embodiments, a single airflow zone 157 may extend across a length of an entire printhead 110 in the cross-process direction. In some embodiments, the airflow zones 157 are shorter in the cross-process direction than a printhead 110 such that multiple airflow zones 157 cover one printhead 110 in the cross-process direction. In some embodiments, an individual airflow zone 157 may be provided with multiple valves 152 which are actuated together to reduce the impedance through the airflow zone 157, which may allow the airflow zones 157 to be larger.

As noted above, in some circumstances the print medium may not fully cover the region of the movable support surface that contains the holes 121, than thus may expose holes 121 and plate holes 127 adjacent to an inboard edge of the print medium. Thus, in some embodiments one or more airflow zones 157 are provided to mitigated inboard edge blur (either exclusively, or in conjunction with also mitigating lead/trail edge blur). For such airflow zones 157 that are intended to mitigate inboard edge blur, their lengths in the cross-process direction determine the relative location of the inboard edge IE of the print media with respect to the airflow zones 157, which affects how well they can mitigate the inboard edge blur and provide hold down force. In particular, optimal blur mitigation and hold down force may be achieved, in some circumstances, when the inboard edge of the print medium is located (in the cross-process direction) at or near the boundary between two airflow zones 157, while less optimal blur mitigation and/or hold down force may occur when the inboard edge is located in the middle of an airflow zone 157. Thus, the airflow zone 157 that are intended to mitigate inboard edge blur may have lengths in the cross-process direction that are chosen to facilitate the mitigating of inboard edge blur, and they may have different lengths than the other airflow zones 157 which do not mitigate inboard edge blur. To maximize effectiveness at mitigating inboard edge blur while also not reducing the hold down force on the print media, the lengths of the airflow zones 157 in the cross-process direction may be set such that, for each size of print media the system is designed to use, the inboard edge of the print media falls along a boundary between two adjacent airflow zones 157. This ensures that uncovered holes 127 inboard of the print media can be prevented from sucking in air (by turning off the airflow zone 157 that is immediately inboard of the inboard edge of the print media) while allowing suction through all of the holes 127 that are covered by the print media (by turning on the airflow zones 157 that are outboard of the inboard edge of the print media). Thus, in such a situation, crossflows along the inboard edge can be mitigated without reducing the hold down force on the print media.

In some embodiments, it may not be feasible or desired to have a perfect correspondence between the edges of the airflow zones 157 and each size of print media. For example, in some systems it might not be feasible to make airflow zones 157 that are short enough in the cross-process direction to perfectly match every size of print media, given the constraints and design goals of that printing system. Thus, in some embodiments, the airflow zones 157 may be sized to correspond to certain sizes of print media, such as frequently used sizes of print media, while not necessarily corresponding to all sizes of print media. In other embodiments, the airflow zones 157 may be provided with lengths in the cross-process direction that are not based on specific sizes of print media, such as each airflow zone 157 having a fixed length. In situations in which the inboard edge of the selected print media falls partway within an airflow zone 157, rather than along the boundary between two airflow zones 157, the system may decide whether to turn on or off that particular airflow zone 157 based on whether blur mitigation or hold down force is prioritized. If blur mitigation is prioritized, then the airflow zone 157 intersected by the edge of the print media may be turned off to ensure no crossflows are induced, at the cost of reducing the hold down force near the edge of the print media because some of the holes 127 corresponding to the airflow zone 157 are covered by the print media but are not provided with vacuum suction. If hold down force is prioritizes, then the airflow zone 157 intersected by the edge of the print media may be turned on to ensure all of the platen holes 127 thar are covered by the print media are provided with vacuum suction, at the cost of allowing some uncovered holes 127 to suction in air and thus induce some crossflows. The airflow control logic 155 may select between these priorities based on any of: a default programed priority, a user selection, the location of the inboard edge relative to the airflow zone 157 (e.g., if the print media covers a predetermined amount of the airflow zone 157 then the airflow zone 157 is turned on, while otherwise the airflow zone 157 is turned off), feedback of an amount of blur that is detected in printed images, of other detected conditions.

The determinations of which airflow zones 157 should be on or off and the timings for turning the airflow zones 157 on or off are described in greater detail below in relation to the control system 130.

The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

The control system 130 also comprises a location tracking system 132, which may be used to track the locations of the inter-media zones and/or print media as the print media are transported through the ink deposition assembly. As used herein, tracking the location of the inter-media zones or the print media refers to the system having knowledge, whether direct or inferred, of where the print media are located at various points as they are transported through the ink deposition assembly 101. Direct knowledge of the locations of the inter-media zones or print media may comprise information obtained by directly observing the print media, for example via one or more sensors (e.g., an edge detection sensor). Inferred knowledge of the locations of the inter-media zones or print media may be obtained by inference from other known information, for example by calculating how far a print medium would have moved from a previously known location based on a known speed of the movable support surface 120. In some embodiments, the location tracking system may explicitly track locations of the inter-media zones, the lead edges LE of print media, and/or the trail edges TE of print media. In other embodiments, the location tracking system may explicitly track the locations of some other parts of the print medium. Because the locations of the inter-media zones depend deterministically on the locations of the print media and on the dimensions of the print media (which are known to the control system 130), tracking the locations of some arbitrary part of the print media is functionally equivalent to tracking the locations of the inter-media zones 122.

Most existing printing systems are already configured to track the locations of the print media as they are transported through the ink deposition assembly, as knowledge of the locations of the print media may be helpful to ensure accurate image formation on the print media. Thus, various systems for tracking the locations of print media are well known in the art. Because such location tracking systems are well known, they will not be described in detail herein. Any known location tracking system (or any new location tracking system) may be used as the location tracking system 132 in the embodiments disclosed herein to track the location of print media.

The processing circuitry of the control system 130 is also configured with airflow control logic 155, among other things. The airflow control logic 155 controls which airflow zones 157 are on or off, as well as timings for turning the airflow zones 157 on and off. The airflow control logic 155 may receive information indicating the size of the print media currently being used or currently selected for upcoming use, and the locations of the inter-media zones as they move through the media transport device 103 (or the locations of the print media being transported through the media transport device, from which the locations of the inter-media zones can be deduced). The airflow control logic 155 also generates control signals to open or close the corresponding valves 152 at the determined timings.

Based on the size of the print media currently being used or selected for use, the airflow control logic 155 determines where the inboard edge of the print media will be located relative to the airflow zones 157. Based on the location the inboard edge relative to the airflow zones 157, the airflow control logic 155 can determine which ducts 155 to keep off throughout the printing process regardless of the location of the inter-media zone, and which airflow zones 157 can be allowed to remain on and be subjected to further control based on the location of the inter-media zone. Each airflow zone 157 that is fully inboard of the inboard edge may be turned off throughout printing, while each airflow zone 157 that is fully outboard of the inboard edge may be left on (and subjected to further control based on the location of the inter-media zone). If the inboard edge of the print media falls midway within any airflow zones 157, then the intersected airflow zones 157 may be turned on or turned off based on whether blur mitigation or hold down force are prioritized, as described above. If the size of the print media being used changes, then the airflow control logic 155 repeats the process of determining which airflow zones 157 should be turned off based on the new size of print media and sends the appropriate control signals to adjust which airflow zones 157 are off as needed.

For the airflow zones 157 that are not turned off based on the size of the print media, the airflow control logic 155 determines the timings when these airflow zones 157 should be turned on/off based on the location of the inter-media zone 122, or in other words based on the locations of the lead edges LE and trail edges TE of the print media. Specifically, airflow control logic 155 actuates the valves 152 at timings that correspond to particular positions of the inter-media zone 122. In other words, particular positions of the inter-media zone 122 are used as triggers for closing and opening each valve 152. In some embodiments, individual airflow zones 157 can be independently controlled, i.e., their respectively associated valves 152 can be independently actuated between open and closed states. In some embodiments, some ducts may be grouped together such that ducts in the same group are all turned on or off together, and the various groups of airflow zones 157 may be independently controlled. The positions used to trigger actuation of the valves 152 may be predetermined parameters which are programmed into a memory associated with the airflow control logic 155 and remain static during operation, or the positions may be dynamic parameters which can be automatically varied/updated during run-time. are turned off at timings that are determined based on the location of the inter-media zone.

Generally, the airflow control logic 155 may turn off a given airflow zone 157 when the inter-media zone is located over the airflow zone 157 and may turn the given airflow zone 157 back on once the inter-media zone has advanced past the duct. More specifically, in some embodiments, each airflow zone 157 is turned off when the downstream edge of the inter-media zone (which corresponds to the trail edge TE of a print medium) is at an upstream trigger location associated with the airflow zone 157. Conversely, each airflow zone 157 is turned on the upstream edge of the inter-media zone (which corresponds to the lead edge LE of a print medium) is at a downstream trigger location associated with the airflow zone 157. In some embodiments, the upstream trigger location associated with a given airflow zone 157 is an upstream edge of the airflow zone 157 and the downstream trigger location associated with the airflow zone 157 is a downstream edge of the airflow zone 157. In some embodiments, the upstream trigger location associated with a given airflow zone 157 is any predetermined position on an upstream side of the airflow zone 157, while the downstream trigger location associated with the given airflow zone 157 is any predetermined position on a downstream side of the airflow zone 157. In some embodiments, upstream and downstream trigger location correspond to portions of other components of the printing system, such as an upstream or downstream face of the printhead 110, an upstream or downstream edge of an ink deposition region of a printhead, etc.

Thus, by controlling the airflow zones 157 as described above, airflow may be blocked throughout the inter-media zone as the inter-media zone moves through the ink deposition assembly, thereby reducing crossflows near the lead and trail edges of the print media. Moreover, airflow is also blocked or reduced through the unblocked holes 127 on an inboard side of the print media, and therefore crossflows are reduced long the inboard edge of the print media. With crossflows reduced or eliminated near the lead, trail, and inboard edges, image blur near these edges is reduced. These phenomena are discussed in greater detail below with reference to FIGS. 5A-6C.

Although preventing suction through the holes 127 reduces crossflows, an issue associated with preventing suction through the holes 127 is that this can interfere with the hold down force being applied to the print media. For example, if the holes 127 near the printheads 110 were permanently blocked or eliminated entirely, this would permanently reduce or eliminate all hold down force in the vicinity of the printheads 110, which might in some circumstances result in the leading edge of a print medium rising off the movable support surface 120, potentially causing jams in the printing system and/or less accurate printing of images on the print medium. In contrast, in the approach described above, each airflow zone 157 is turned off only for a relatively brief period of time corresponding generally to the time it takes for the inter-media zone 122 to move past the airflow zone 157. Moreover, at any given time the number of holes 127 that are covered by print media but prevented from providing suction to the print media is relatively low, since only a few airflow zones 157 are turned off at any given time and each airflow zone 157 corresponds to a relatively small number of holes. Thus, using the approaches described herein, there is generally sufficient hold down force applied to the print media at any given time to reduce the risk of the print media rising off the movable support surface 120 to an acceptably small level. In systems in which hold down force is of particular concern, the amount with which the airflow zones 157 reduce the hold down force can be tuned by adjusting the width and number of the airflow zones 157 in the process direction. Providing narrower and more numerous airflow zones 157 in the process direction may allow for more fine-grained control of turning the airflow zones 157 on and off following the movements of the inter-media zone, thus recuing the degree to which the airflow zones 157 interfere with the hold down force.

Figure 3:
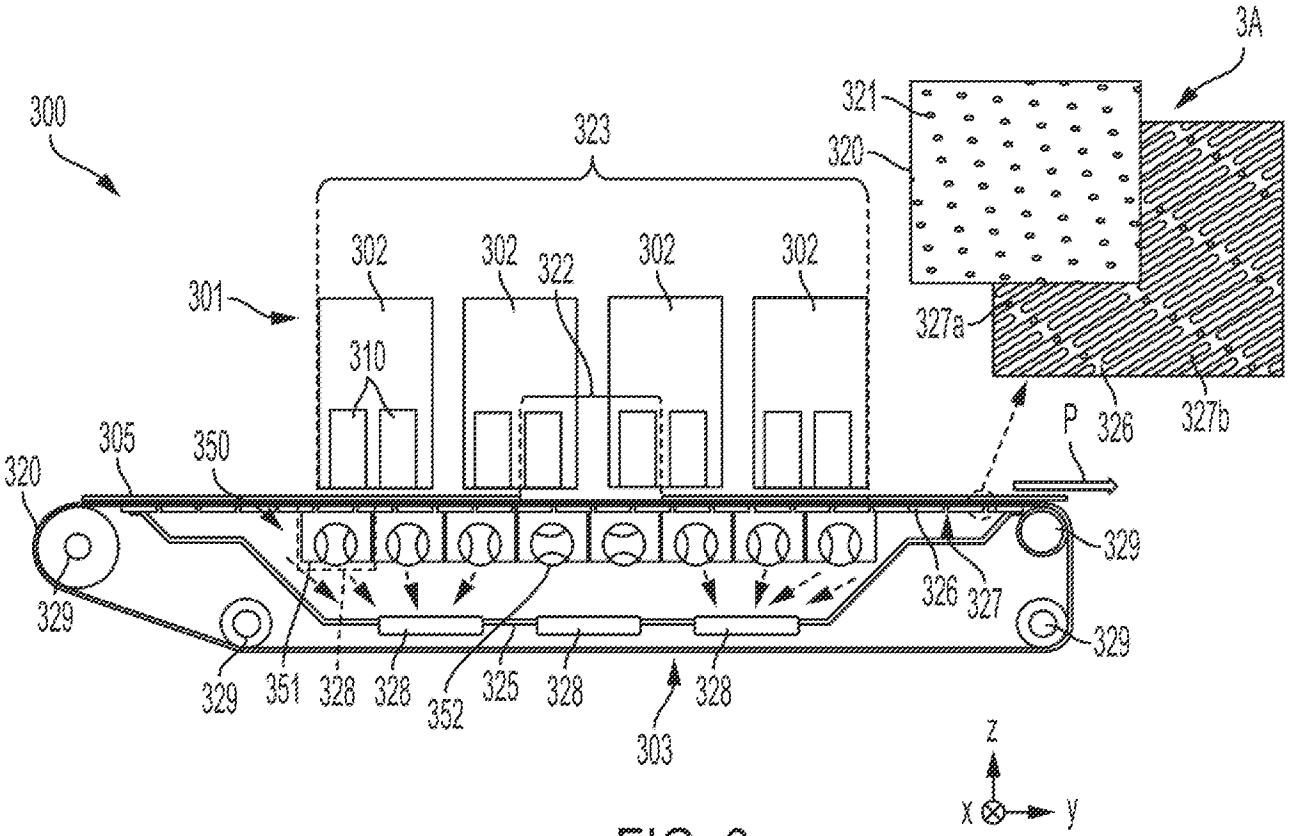
FIG. 3 is a schematic illustration of a side view of components of an embodiment of an inkjet printing system.
Figure 4:
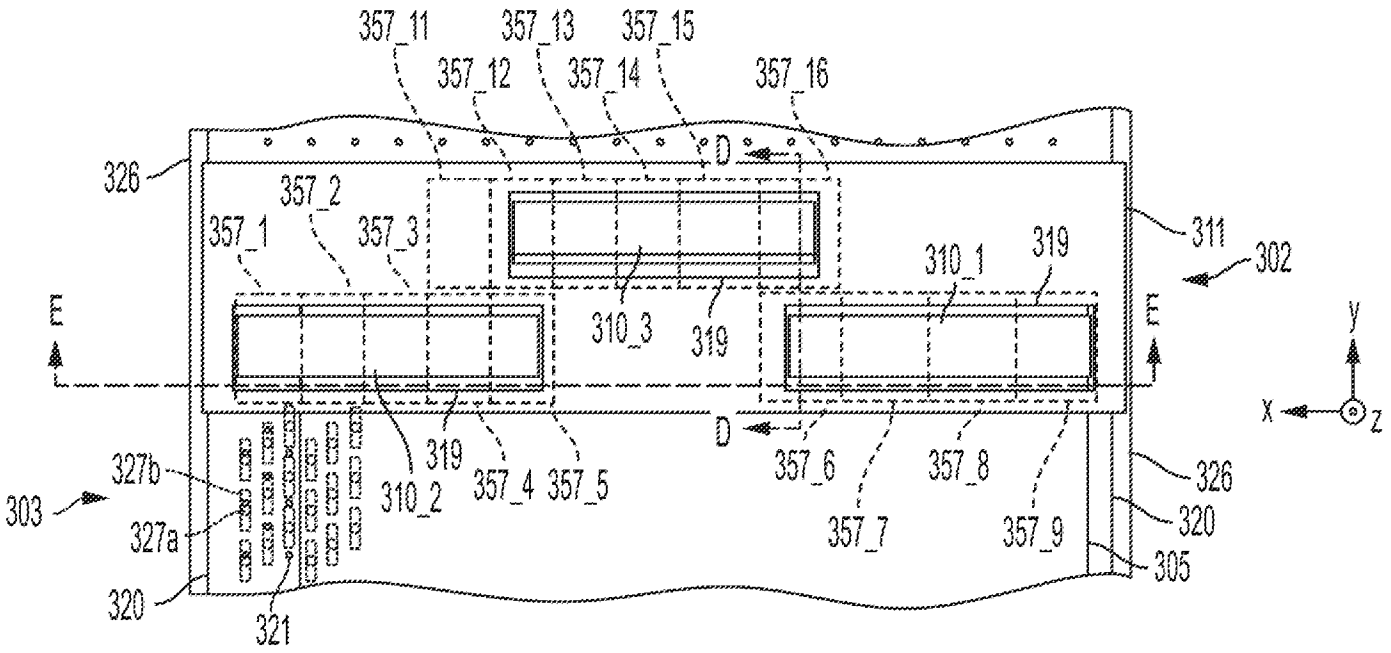
FIG. 4 is a partial plan view of the inkjet printing system of FIG. 3, depicting a single inkjet printhead module.
Figure 5A:
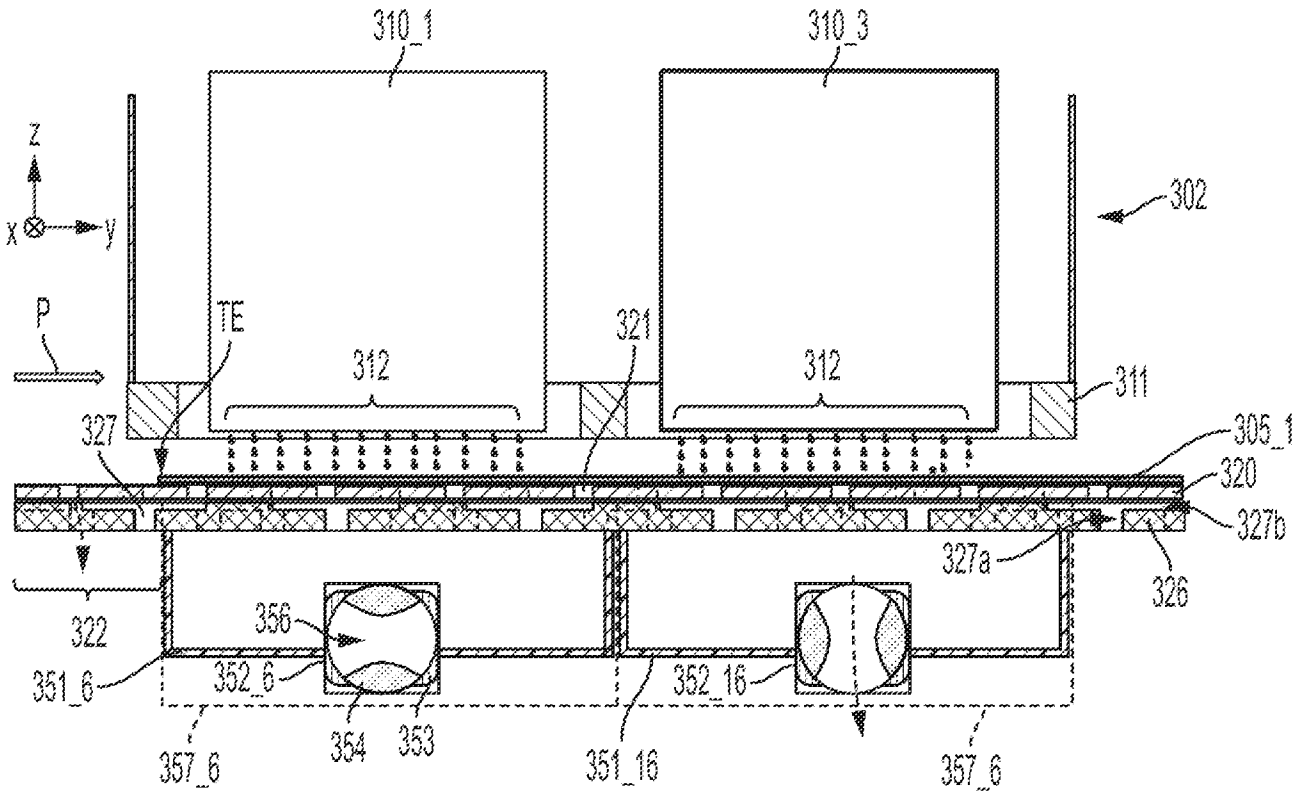
FIGS. 5A-5F are cross-sectional views of the inkjet printing system of FIG. 4, with the cross-section taken along D in FIG. 4.
Figure 5B:
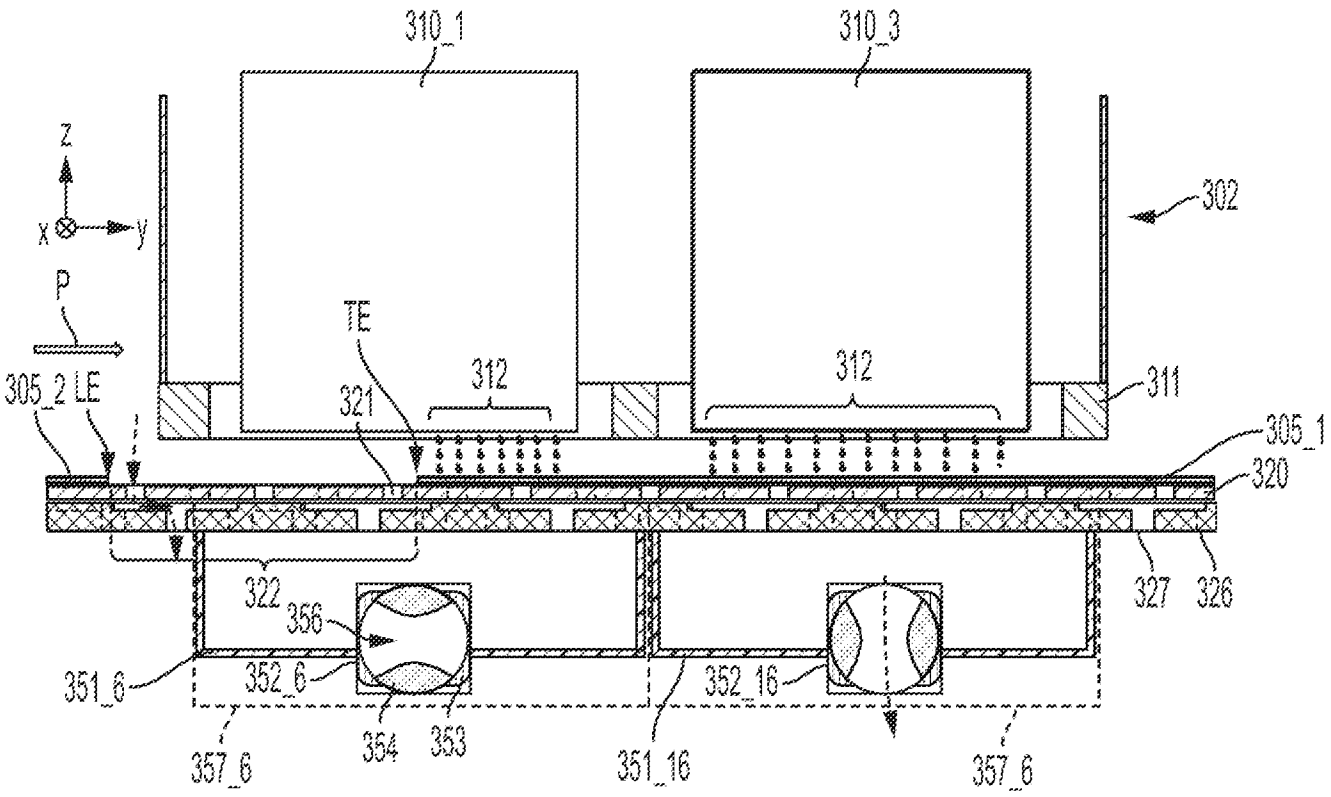
Figure 5C:
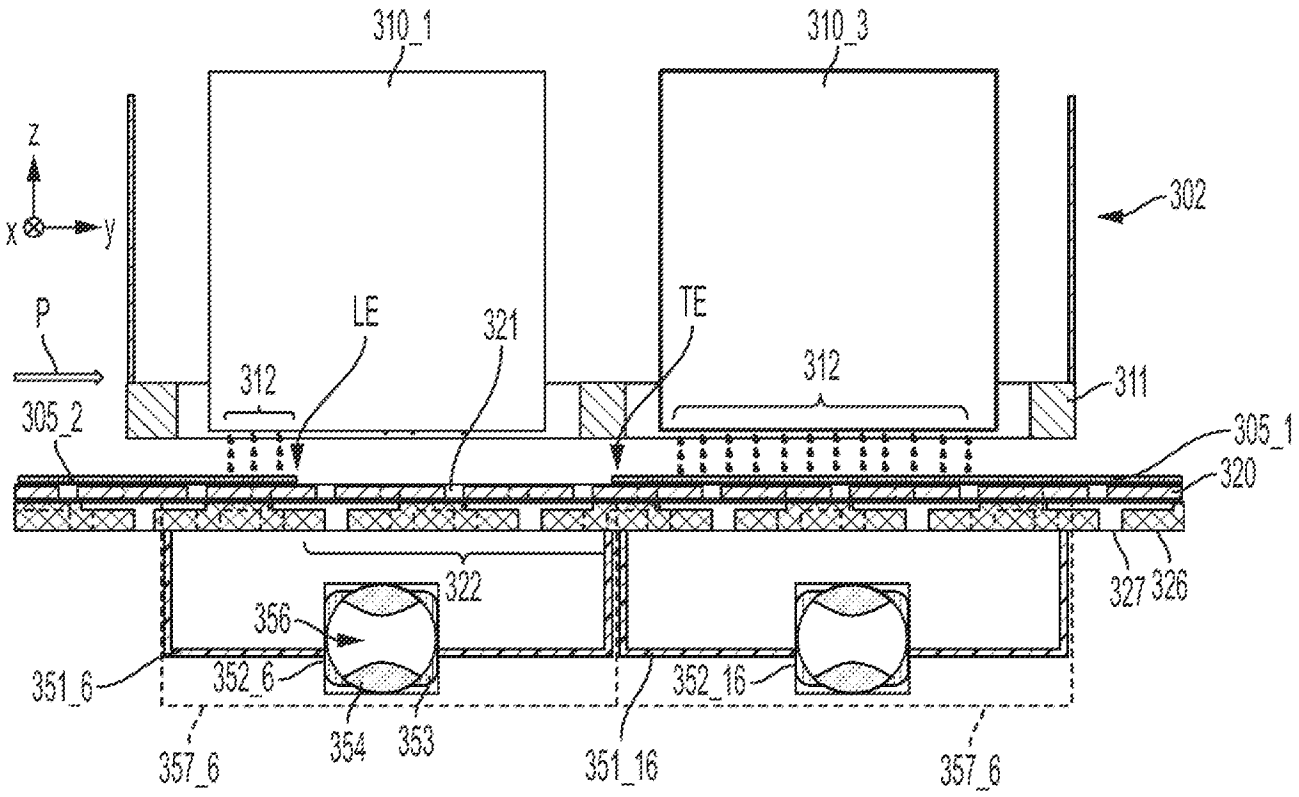
Figure 5D:
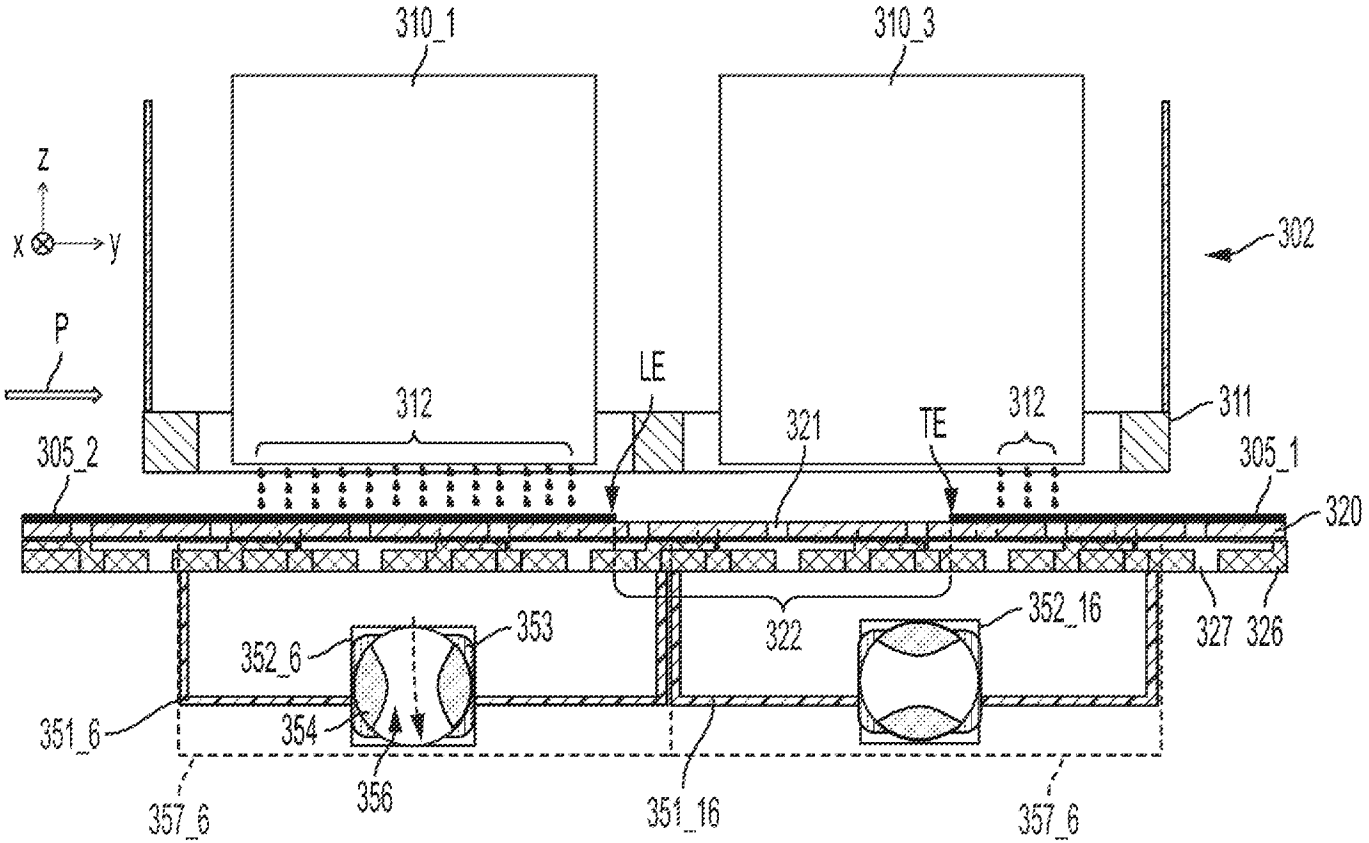
Figure 5E:
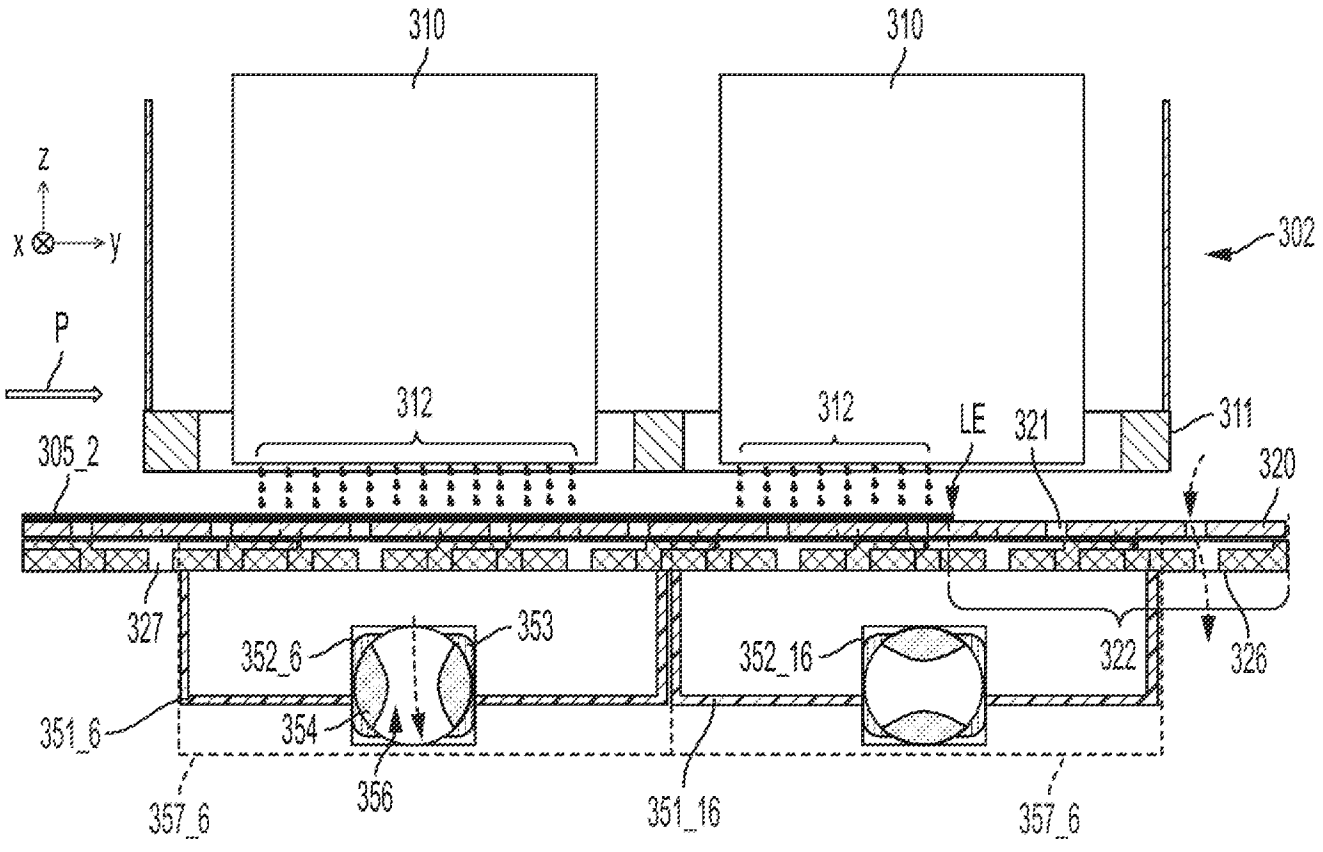
Figure 5F:
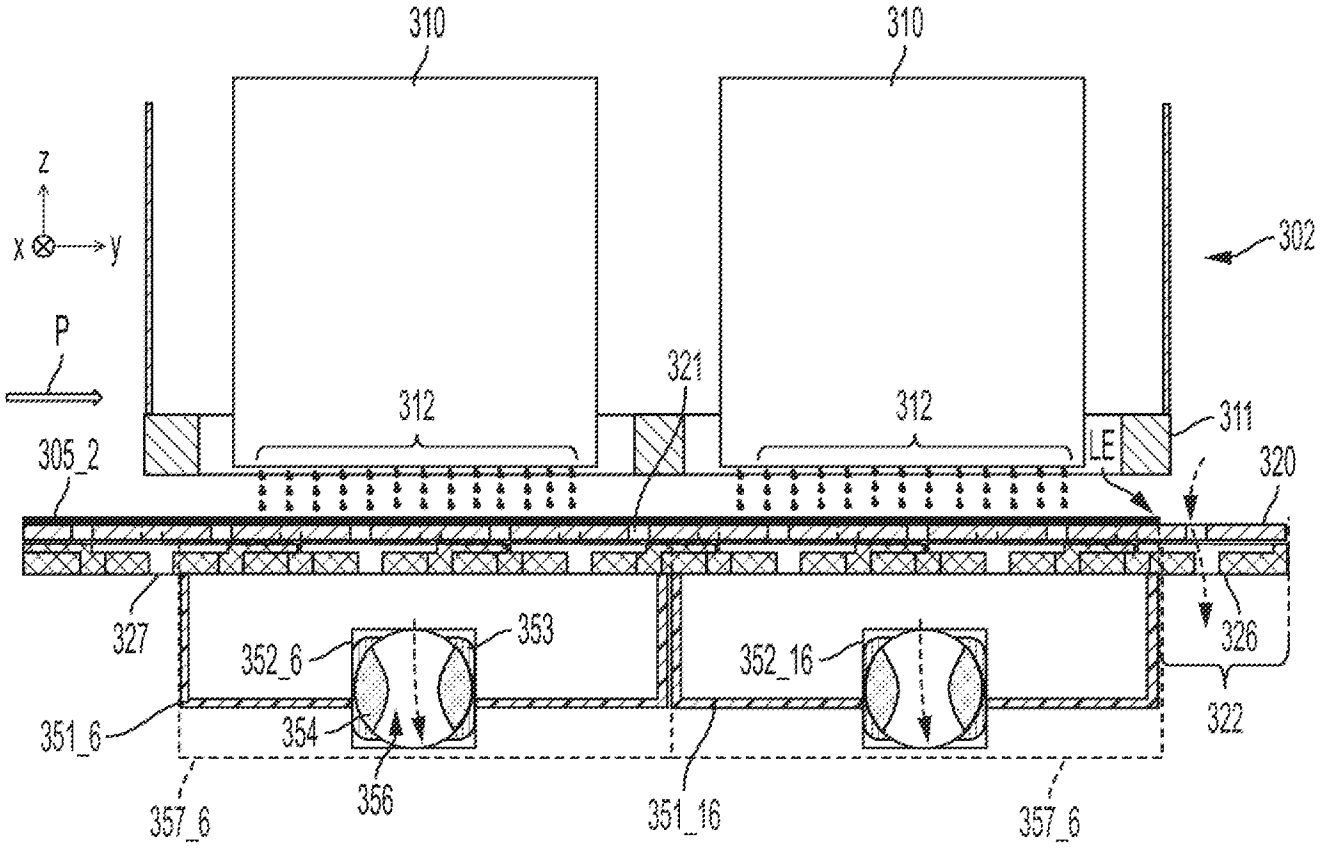
Figure 6A:
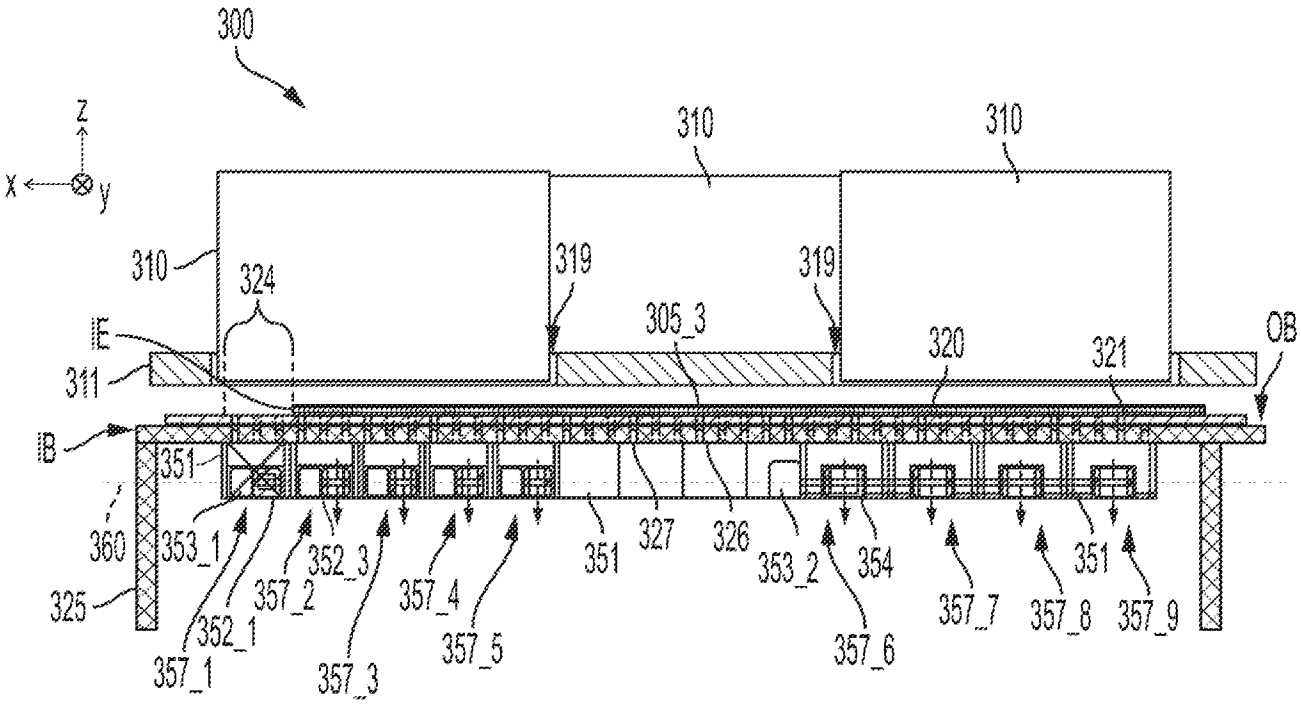
FIGS. 6A-6C are cross-sectional views of the inkjet printing system of FIG. 4, with the cross-section taken along E in FIG. 4.
Figure 6B:
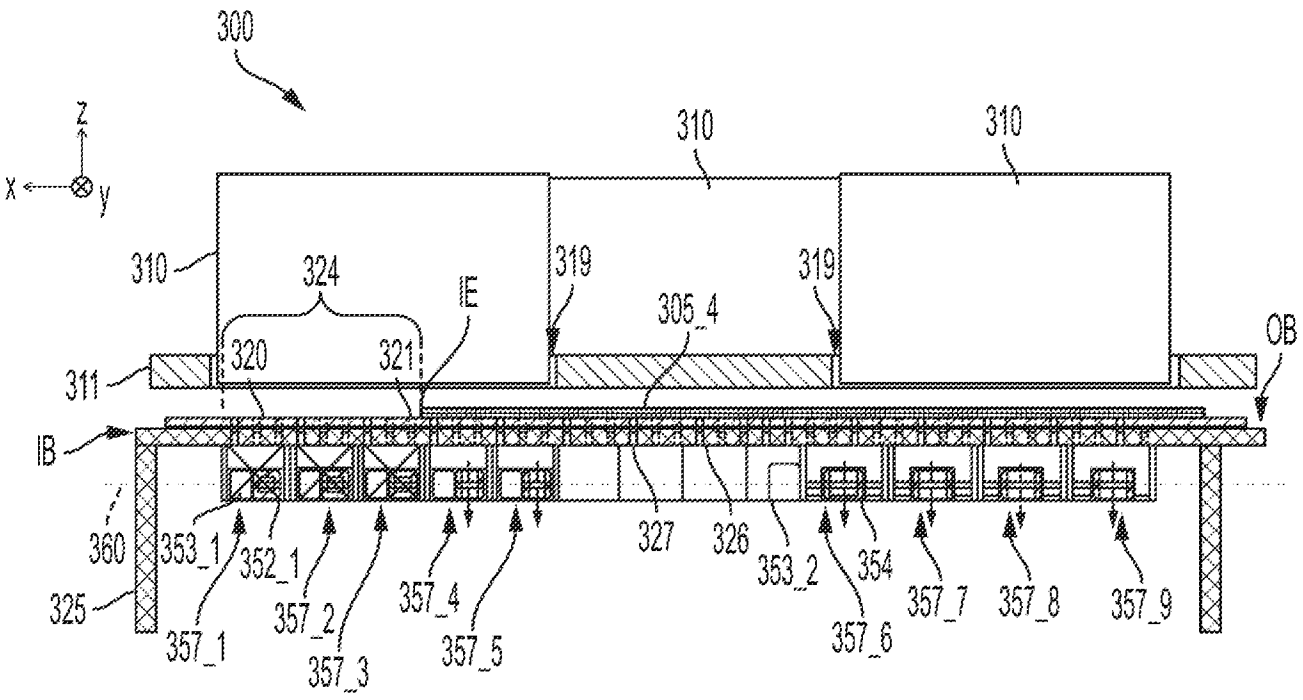
Figure 6C:
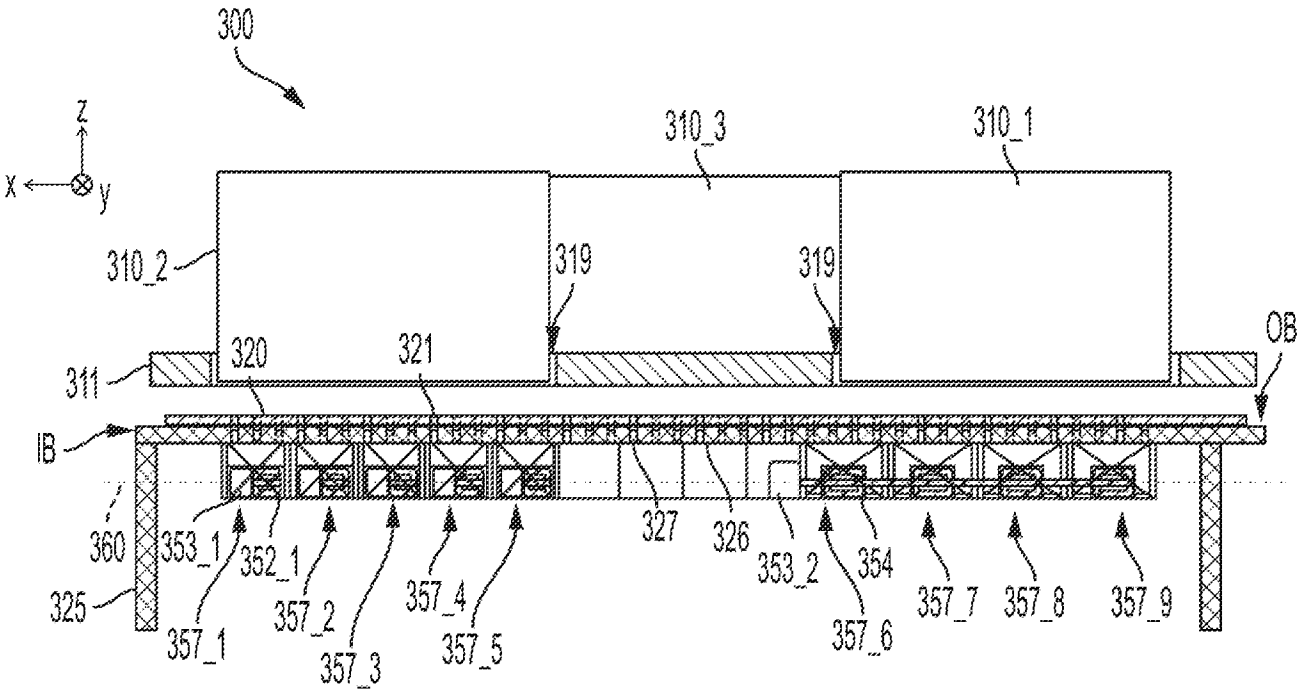

FIGS. 3-6C illustrate another embodiment of a printing system 300, which may be used as the printing system 100 described above with reference to FIG. 2. FIG. 3 comprises a schematic illustrating a portion of the printing system 300 from a side view. FIG. 4 comprises a partial plan view from above a portion of the printing system 300 and depicting only a single printhead module 302. In FIG. 4, some components that would not otherwise be visible in the view because they are positioned below other components are illustrated with dashed or dotted lines. FIGS. 5A-5F comprise cross-sections of the printing system 300 with the section taken along line D-D in FIG. 4, with each of FIGS. 5A-5F showing a sequence of states as the print media 305_1 and 305_2 are transported past one of the printhead modules 302. FIGS. 6A-6C comprise cross-sections of the printing system 300 with the section taken along line E-E in FIG. 4, with FIGS. 6A-6C illustrating various different states.

As illustrated in FIG. 3, the printing system 300 comprises an ink deposition assembly 301, a media transport device 303, and an airflow control system 350, which can be used as the ink deposition assembly 101, media transport device 103, and airflow control system 150, respectively, which were described above with reference to FIG. 2. The printing system 300 may also comprise additional components not illustrated in FIGS. 3-6B, such as a control system (e.g., similar to control system 130) including airflow control logic (e.g., similar to airflow control logic 155).

In the printing system 300, the ink deposition assembly 301 comprises four printhead modules 302 as shown in FIG. 3, with each module 302 having three printheads 310 (e.g., printheads 310_1 through 310_3) as shown in FIG. 4. As shown in FIGS. 3 and 4, the printhead models 302 are arranged in series along a process direction P above the media transport device 303, such that the print media 305 is transported sequentially through an ink deposition region 323 of the ink deposition assembly, i.e., beneath each of the printhead modules 302. The printheads 310 are arranged to eject print fluid (e.g., ink) through respectively corresponding openings 319 in a corresponding carrier plate 311 (shown in FIG. 4), with a bottom end of the printhead 310 extending down partway into the opening 319. In this embodiment, the printheads 310 are arranged in an offset manner with one of the printheads 310 being further upstream or downstream than the other two printheads 310 of the same printhead module 302. Those having ordinary skill in the art would understand that other embodiments within the scope of the disclosure could have different numbers and/or arrangements of printheads 310 and/or printhead modules 302 are used, which may be selected based on a particular system or application.

In the printing system 300, media transport device 303 comprises a flexible belt providing the movable support surface 320. As shown in FIG. 3, the flexible belt comprising the movable support surface 320 is driven by rollers 329 (the number and arrangement of which in FIG. 3 is nonlimiting as those of ordinary skill in the art would appreciate) to move along a looped path, with a portion of the path passing through the ink deposition region 323 of the ink deposition assembly 301. Furthermore, in this embodiment, the vacuum plenum 325 comprises a vacuum platen 326, which forms a top wall of the plenum 325 and supports the movable support surface 320. The platen 326 comprises platen holes 327, which allow fluidic communication between the interior of the plenum 325 and the underside of the movable support surface 320.

In some embodiments, the platen holes 327 may include channels on a top side thereof, as seen in the expanded cutaway 3A of FIG. 3, which may increase an area of the opening of the platen holes 327 on the top side thereof. Specifically, the platen holes 327 may include a bottom portion **327*a* which opens to a bottom side of the platen 326** and a top potion 327*b* which opens to a top side of the platen 326, with the top portion 327*b* being differently sized and/or shaped than the bottom portion 327*a*. For example, FIGS. 3-6C illustrate an embodiment of the platen holes 327 in which the top portion 327*b* is a channel elongated in the process direction while the bottom portion 327*a* is a through-hole that is less-elongated and has a smaller sectional area (see the enlargement D in FIG. 3 and the dashed-lines in FIG. 4). In some embodiments, multiple platen holes 327 may share the same top portion 327*b*, or in other words multiple bottom portions 327*a* may be coupled to the same top portion 327*b*. References herein to the airflow zones 357 blocking a platen hole 327 refer to blocking at least the bottom portion 327*a* of the platen hole 327.

The platen holes 327 are arranged in columns extending in the process direction P (y-direction shown in FIGS. 3 and 4) and rows extending in a cross-process direction (the x-direction shown in the FIGS. 3 and 4), with each column comprising a group of holes 327 that are aligned with one another in the process direction P and each row comprising a group of one or more holes 327 aligned with one another in a cross-process direction. In some embodiments, the columns and rows are arranged in a regular grid, but in other embodiments the columns and rows are arranged in another manner that does not form a regular grid. For example, in some embodiments, such as the embodiment of FIG. 4, the holes 327 (top portion 327*b*, bottom portions 327*a*, or both) of two adjacent columns may be offset or staggered from one another in the process direction P. In other words, a hole 327 in one column may not be aligned in the cross-process direction with any holes 327 in an adjacent column. Similarly, in some embodiments the holes 327 (top portion 327*b*, bottom portion 327*a*, or both) of two adjacent rows are offset or staggered from one another in the cross-process direction. In other words, a hole 327 in one row may not be totally aligned in the process direction with any holes 327 in an immediately adjacent row. In some embodiments, the holes 327 (top portion 327*b*, bottom portion 327*a*, or both) in each individual column are arranged with uniform spacing in the process direction, but in other embodiments some or all of the holes 327 in one or more columns may have non-uniform spacings. In some embodiments, the holes 327 (top portion 327*b*, bottom portion 327*a*, or both) in each individual row are arranged with uniform spacing in the cross-process direction, but in other embodiments some or all of the holes 327 in one or more rows may have non-uniform spacings. In some embodiments, each column has the same number of holes 327 as the other columns and/or each row has the same number of holes 327 as the other rows, but in some embodiments some or all of the columns and/or rows have differing numbers of holes 327. In embodiments in which the holes 327 have bottom portions 327*a* and top portions 327*b* with different shapes/sizes, references herein to the holes 327 being aligned refer to the bottom portions 327*a* of the holes being 327 aligned.

The holes 321 of the movable support surface 320 are disposed such that each hole 321 is aligned in the process direction P (y-axis direction) with a collection of corresponding platen holes 327. In other words, in the printing system 300, each hole 321 is aligned in the with one of the columns of platen holes 327. Thus, as the movable support surface 320 slides across the platen 326, each hole 321 in the movable support surface 320 will periodically move over a corresponding platen hole 327, resulting in the movable support surface hole 321 and the platen hole 327 being temporarily vertically aligned (i.e., aligned in a z-axis direction). When a hole 321 of the movable support surface 320 moves over a corresponding platen hole 327, the holes 321 and 327 define an opening that fluidically couples the environment above the movable support surface 320 to the low-pressure state in the vacuum plenum 325, thus generating vacuum suction through the holes 321 and 327. This suction generates a vacuum hold down force on a print medium 305 if the print medium 305 is disposed above the hole 321.

As shown in FIGS. 3-6B, the airflow control system 350 comprises airflow zones 357, which may be used as the airflow zones 157 described above in relation to FIG. 2. The airflow zones 357 each comprise a group of the platen holes 327, a duct 351 that surrounds outlet openings of the group of platen holes 327 to control airflow through the group of platen holes 327, and a valve 352 to control airflow through the duct 351. The ducts 351 and valves 352 of FIGS. 3-6B may be used as the ducts 151 and valves 152 described above in relation to FIG. 2. An example arrangement of airflow zones 357 is illustrated in FIGS. 3-6C with respect to one printhead module 302. Similar arrangements of airflow zones 357 may be provided for the other printhead modules 302 of the printing system 300. The arrangement illustrated in FIGS. 3-6C is merely an example, and in other embodiments any number of airflow zones 357 may be provided and they may have different sizes, shapes, and locations than those illustrated. The description above of how the locations and sizes of airflow zones 157 may be selected is applicable to selecting locations and sizes for the airflow control zones 351.

As shown in FIGS. 3 and 5A-6C, in the printing system 300, the airflow zones 357 are created by the actuatable valving 352 and segregated ducts 351 disposed against a bottom surface of the platen 326 to provide selective communication with the vacuum plenum 325. As shown in FIGS. 4-6C, a number of the airflow zones 357 are located directly under the printheads 310 (e.g., airflow zones 357_1 through 351_11 and 351_13 through 351_16). In this embodiment, the airflow zones 357 have a width in the process direction that is slightly longer than the openings 319 in the carrier plate 311 through which the printheads 310 eject ink. In other embodiments narrower airflow zones 357 may be used, for example, with two rows of airflow zones 357 being provided for each printhead 310.

In addition, some airflow zones 357 may be provided that are not located under any printhead 310, such as the airflow zone 357_12. Such airflow zones 357 may be provided, for example, to combat inboard edge blur. The number and location of such airflow zones 357 that are not located under a printhead 310 may vary from system to system based on the needs of the system, such as the sizes of print media that are to be used and the amount of image blur that is deemed acceptable. In the embodiment of FIGS. 3-6C, the airflow zone 357_12 is provided inboard of the printhead 310_3 to mitigate inboard edge blur resulting from ink ejected by the printhead 310_3 in situations in which inboard edge IE of the print media is near the edge of the printhead 310_3 (see FIG. 4). In the embodiment of FIGS. 3-6C, just one airflow zone 357 is provided inboard of the printhead 310_3, but in other embodiments additional airflow zones 357 could be provided on the inboard side of the printhead 310_3 along with the airflow zone 357_12. In some embodiments (not illustrated), airflow zones 357 that are not located under a printhead 310 may include airflow zones 357 disposed in the region between the printheads 310_1 and 310_2. Such airflow zones 357 may be particularly useful, for example, in systems in which it is possible or likely for the inboard edge of the print media to fall between the printheads 310_1 and 310_2. However, if desired the airflow zones 357 can also be omitted from the space between the printheads 310_1 and 310_2, such as in the embodiment illustrated in FIGS. 3-6C. Omitting the airflow zones 357 between the printheads 310_1 and 310_2 may be particularly suitable, for example, in systems in which it is unlikely for the inboard edge IE of the print media to fall between the printheads 310_1 and 310_2.

As shown in FIGS. 5A-6C, the ducts 351 comprise walls that define passageway or conduit having one end that opens to the bottom side of the platen 326 and another end that opens to the interior of the vacuum plenum 325. A corresponding valve 352 is positioned at an opening of the duct 351 to control airflow through the duct 351 (and hence control airflow through the airflow zone 357). As shown in FIGS. 5A-6C, each of the valves 352 comprise an outer valve body 353 and an inner valve body 354 disposed within the outer valve body 353. The inner valve body 354 has a passageway 356 extending diametrically through the body 354. The inner valve body 354 is rotatable relative to the outer valve body 353 to an open state of the valve 352 in which the passageway 356 is aligned with openings in the outer valve body 353, thus allowing airflow through the valve 352 via the passageway 356. In the open state, the passageway 356 places the interior of the duct 351 in fluidic communication with the vacuum plenum 325 (see, e.g., the valve 352_2 in FIG. 6A). The inner valve body 354 is also rotatable relative to the outer valve body 353 to a closed state of the valve 352 in which the passageway 356 is not aligned with the openings in the outer valve body 353 and the inner and outer valve bodies 353 and 354 seal the interior of the duct 351 from the vacuum plenum 325 (see, e.g., the valve 352_1 in FIG. 6A). As shown in FIGS. 6A-6C, each valve 352 may be selectively actuated between the open and closed states by a drive shaft driven by an actuator 353. Some valves 352 may have their own individual actuator 353, such as the actuator 353_1 which actuates the valve 352_1 in FIG. 6A-6C. Other valves 352 may share an actuator 353 amongst multiple valves 352, such as the valves 352 of the airflow zones 357_6 to 357_9 in FIG. 6A-6C which all share the same actuator 353_2 (i.e., the valves 352 are all coupled to the same drive shaft 354, which is driven by the actuator 353_2).

In some embodiments, individual control of valves 352 may be provided even without providing each valve 352 with its own actuator 353. For example, a group of valves 352 could be ganged together on the same drive shaft 354 and share the same actuator 353, similar to the valves 352 of the airflow zones 357_6 to 357_9 in FIGS. 6A-6C, but could be individually controlled by providing mechanisms at each of the valves 352 to allow selective coupling and decoupling of the valves from the drive shaft 354. Thus, if a given airflow zone 357 is to be turned off due to the location of the inboard edge IE of the print media 305, then the valve 352 of that airflow zone 357 can be moved to the closed stated and then it can be decoupled from the drive shaft 354 such that subsequent actuations of the shaft 354 to open the other ganged valves 352 (e.g., based on the location the inter-media zone 322) do not result in the decoupled valve 352 from opening.

As shown in FIGS. 4 and 6A, the lengths of the airflow zones 357 in the cross-process direction (x-axis direction) are not necessarily the same for each airflow zone 357. For example, considering FIG. 6A, the airflow zones 357_1 to 357_5 are shorter in the cross-process direction than the airflow zones 357_6 to 357_9. In this embodiment, the length of the airflow zones 357_1 to 357_5 in the cross-process direction is controlled such that edges of the airflow zones 357_1 to 357_5 correspond to locations of the inboard edges IE of different sizes of print medium 305, such as the print mediums 305_3 and 305_4 illustrated in FIGS. 6A and 6B. Moreover, by having the length of the airflow zones 357_1 to 357_5 in the cross-process direction be relatively short, in the event that the inboard edge IE of a print medium 305 falls in the middle of an airflow zone 357, the area of overlap is kept relatively small and thus only a small region will be allowed to suction air if the overlapped airflow zone 357 is turned on or only a small region will have its hold down force reduced if the overlapped airflow zone 357 is turned off. The airflow zones 357_6 to 357_9, on the other hand, are not intended to address inboard edge blur and do not need to align with the inboard edges of print media 305, and thus they may be relatively long in the cross-process direction. Moreover, because the airflow zones 357_6 to 357_9 are aligned in the cross-process direction and because they are not intended to address inboard edge blur, the airflow zones 357_6 to 357_9 do not necessarily need to be individually controllable and thus can be configured to all be controlled to turn on or turn off together, as described above.

In the printing system 300, the determination of which airflow zones 357 to turn on or off and the timings for doing so are similar to those described above with respect to the ducts 151. In particular, a specific example of the timings for turning on and off airflow zones 357 based on the location of the inter-media zone 322 is described below with reference to FIGS. 5A-5F, which illustrate various positions of the inter-media zone 322 at which closing or opening of the airflow zones 357 are triggered. As noted above, each airflow zone 357 has a first (upstream) trigger location and a second (downstream) trigger location associated with it, and the airflow zone 357 is turned off (its valve 352 is closed) when the inter-media zone 322 reaches a position associated with the first trigger location and is turned back on (its valve 352 is opened) when the inter-media zone 322 reaches a position associated with the second trigger location. FIGS. 5A-5F illustrate trigger locations of one embodiment, but in other embodiments different trigger locations are used. The first and second trigger locations may be any predetermined locations.

Note that, in practice, it takes a finite amount of time for the valves 352 to fully close or open, and during this time while a valve 352 is closing or opening the inter-media zone 322 continues to move. Thus, in some embodiments, to ensure that the airflow zone 357 is fully off or fully on when the inter-media zone 322 reaches a desired trigger location ("nominal trigger location"), the corresponding valve 352 may need to start closing or opening shortly before the inter-media zone 322 actually reaches the nominal trigger location. In other words, an actual trigger location that is used to trigger the closing or opening may be offset from the nominal trigger location by some fixed amount to account for the finite amount of time it takes the valves 352 to close or open. The known speed of the movable support surface 320 and a known actuation time for the valves 352 may be used to determine the offset. To simplify the description, only the nominal trigger locations are discussed below.

In the embodiment of FIGS. 5A-5F, the trigger locations for each airflow zone 357 correspond to upstream and downstream edges of the respective airflow zone 357. FIG. 5A illustrates the inter-media zone 322 in a first position. The first position corresponds to the downstream edge of the inter-media zone 322 (i.e., the trail edge TE of the print medium 305_1) reaching a first trigger location associated with the airflow zone 357_6. Specifically, the inter-media zone 322 reaches the first trigger location when the trail edge TE of the print medium 305_1 is at (i.e., vertically aligned with) the upstream edge of the airflow zone 357_6. Thus, at (or shortly before) the timing when the inter-media zone 322 reaches the first trigger location, the controller causes the valve 352_6 to close, placing the airflow zone 357_6 in the off state. In the state illustrated in FIG. 5A, the other airflow zones 357 associated with the same printhead module 302 are not closed because the inter-media zone 322 has not yet arrived at the trigger locations associated with those airflow zones 357.

FIG. 5B illustrates the inter-media zone 322 at a second position in which the trail edge TE of the print medium 305_1 is about midway under the printhead 310_1. This position is similar to the position of the inter-media zone 22 in FIG. 1A. As described above with respect to FIG. 1A, if countermeasures are not taken, then in this state the inter-media zone 322 is likely to pull air from the downstream side of the printhead 310_1 through the ink deposition region 312 of the printhead 310_1 and thus create crossflows that cause image blur. However, in contrast to the situation illustrated in FIG. 1A, in FIG. 5B the airflow zone 357_6 is turned off (i.e., the valve 352_6 is in the closed state) and thus air cannot be suctioned through the holes 327 that are associated with the airflow zone 357_6. Thus, crossflows are prevented or reduced. In the state illustrated in FIG. 5B, a portion of the inter-media zone 322 is not blocked by the airflow zone 357_6, and thus some air is suctioned through the inter-media zone 322, as indicated by the dash-lined arrow. However, the unblocked portion of the inter-media zone 322 is relatively distant from the downstream side of the printhead 310_1 and has access to air from the upstream side of the printhead module 302, and thus this portion of the inter-media zone 322 is unlikely to have much of an influence on the air underneath and/or downstream of the printhead 310_1.

FIG. 5C illustrates the inter-media zone 322 at a third position. The third position corresponds to the downstream edge of the inter-media zone 322 (i.e., the trail edge TE of the print medium 305_1) reaching a first trigger location associated with the airflow zone 357_16. Specifically, the inter-media zone 322 reaches this trigger location when the trail edge TE of the print medium 305_1 is at the upstream edge of the airflow zone 357_16. Thus, at (or shortly before) the timing when the inter-media zone 322 reaches the third position, the controller causes the valve 352_16 associated with the airflow zone 357_16 to close, placing the airflow zone 357_16 in the off state. The airflow zone 357_6 remains off in this state because the inter-media zone 322 has not yet fully passed it.

In the state illustrated in FIG. 5C, lead edge LE of the print media 305_2 is under the printhead 310_1. This state is similar to the state illustrated in FIG. 1D. As described above with respect to FIG. 1D, if countermeasures are not taken, in this state the inter-media zone 322 is likely to suck air from the upstream side of the printhead 310_1, which will cross through the ink-deposition region 312 of the printhead 310_1 and thus form a crossflow that can cause image blur. However, in contrast to the situation illustrated in FIG. 1D, in FIG. 5C the airflow zone 357_6 is turned off (i.e., by virtue of the valve 352_6 being in the closed state) and thus air cannot be suctioned through the holes 327 that are associated with the airflow zone 357_6. Thus, the aforementioned crossflows are prevented or reduced.

FIG. 5D illustrates the inter-media zone 322 at a fourth position. The fourth position corresponds to the upstream edge of the inter-media zone 322 (i.e., the lead edge LE of the print medium 305_2) reaching a second (downstream) trigger location associated with the first airflow zone 357_6. Specifically, the inter-media zone 322 reaches this trigger location when the lead edge LE of the print medium 305_2 is at the downstream edge of the airflow zone 357_6. Thus, at (or shortly before) the timing when the inter-media zone 322 reaches the fourth position, the controller causes the valve 352 associated with the airflow zone 357_6 to move to the open state, placing the airflow zone 357_6 in the on state. Because the airflow zone 357_6 is placed in the on state, vacuum suction resumes being applied to the print medium 305_2 in that region. Thus, for a period of time while the lead edge LE moved over the airflow zone 357_6, the print medium 305_2 is not subjected to hold down force in the vicinity of the airflow zone 357_6. However, because suction resumes through the airflow zone 357_6 as soon as the lead edge LE of the print medium 305_2 passes the airflow zone 357_6, the period in which the lead edge LE is subjected to reduced hold down force is relatively brief. Moreover, other portions of the print medium 305_2 are also subjected to hold down suction while the lead edge LE is traversing the airflow zone 357_6, and between this and the relatively brief duration of the reduced suction, the print medium 305_2 is unlikely to lift off of the movable support surface 320.

In the state illustrated in FIG. 5D, the second airflow zone 357_16 remains off because the inter-media zone 322 has not yet fully passed it. In particular, in this state the trail edge TE of the print medium 305_1 is under the printhead 310_3. This position is similar to the position of the inter-media zone 22 in FIG. 1A, and in this position the inter-media zone 322 would normally create crossflows from the downstream side of the printhead 310_3 to flow under the printhead 310_3 toward the inter-media region 322. However, because the airflow zone 357_16 is off, such crossflows are prevented or reduced. Similarly, as shown in FIG. 5E, when the inter-media zone 322 advances further downstream to a fifth position at which the lead edge LE of the print medium 305_2 is under the printhead 310_3, the airflow zone 357_16 being off prevents the crossflows that might have otherwise been induced in this state (see discussion of FIG. 1D above for how crossflows would otherwise be induced in this state).

FIG. 5F illustrates the inter-media zone 322 at a sixth position. The sixth position corresponds to the upstream edge of the inter-media zone 322 (i.e., the lead edge LE of the print medium 305_2) reaching a second (downstream) trigger location associated with the second airflow zone 357_16. Specifically, the inter-media zone 322 reaches this trigger location when the lead edge LE of the print medium 305_2 is at the downstream edge of the airflow zone 357_16. Thus, at (or shortly before) the timing when the inter-media zone 322 reaches the sixth position, the controller causes the valve 352_16 associated with the airflow zone 357_16 to open, placing the airflow zone 357_16 in the on state. Because the airflow zone 357_16 is placed in the on state, vacuum suction resumes being applied to the print medium 305_2 in that region.

After the state illustrated in FIG. 5F, the airflow zones 357_6 and 351_16 are kept in the on state so that they can continue provide vacuum suction to hold down the print media 305. The airflow zones 357_6 and 351_16 may be kept in the on state until a next inter-media zone 322 approaches the printhead module 302, whereupon the cycle is repeated.

Although the actuation timings of just two airflow zones 357_6 and 351_16 are described above with reference to FIGS. 5 and 6, it should be understood that similar actuation timings apply to the other airflow zones 357 in the printing system 300. Airflow zones 351 that are aligned in the cross-process direction may be actuated at the same timings as one another, except for those airflow zones 357 that are to be kept off throughout the printing process due to the size of the print media 305 to prevent crossflows due to exposed inboard edges as have been described.

FIGS. 6A-6C show cross-sections taken along E in FIG. 4, which illustrate various states of the printing system 300. In FIGS. 6A-6C, airflow zones 357 are depicted in the off state and on state, with the off state being indicated in these figures by an X through the airflow zone 357. The on state of an airflow zone 357 is indicated in these figures by the absence of the X and the presence of a dash-lined arrow indicating airflow through the airflow zone 357.

In FIG. 6A, the print medium 305_3 is being used, and the size of this print medium 305_3 is such that its inboard edge IE lands between the first and second airflow zones 357_1 and 351_2. Thus, the airflow control system 350 turns off each airflow zone 357 that is inboard of the inboard edge IE, namely the airflow zone 357_1, throughout printing regardless of the location of the inter-media zone 322. The other the airflow zones 357 that are outboard of the inboard edge IE are allowed to remain on and are subjected to the above-described control related to the location of the inter-media zone 322. Thus, suction through the uncovered platen holes 327 in the uncovered region 324 adjacent the inboard edge IE of the print medium 305_3 is prevented, thereby eliminating or reducing the crossflows that would otherwise have been induced by the uncovered region 324, while still maintaining full hold-down force along the print medium 305_3 (see the discussion of FIG. 1G above for how the crossflows would otherwise have been induced).

If a different size of print medium is used, then the airflow control system 350 determines anew which airflow zones 357 to turn off. For example, as illustrated in FIG. 6B, if a print medium 305_4 is used that is sized such that its inboard edge IE lands between the airflow zones 357_3 and 351_4, then the airflow zones 357_1 through 351_3 are turned off throughout printing regardless of the location of the inter-media zone 322, while the remaining airflow zones 357 are allowed to remain on. Those having ordinary skill in the art would understand how to selectively turn on or off ducts depending on the size of the print medium and its relative positioning of inboard and outboard edges IE, OE, with the embodiments of FIGS. 6A-6C being nonlimiting.

FIG. 6C illustrates a state in which the inter-media zone is directly above the airflow zones 357_1 through 351_9. In this state, all of the airflow zones 357_1 through 359_9 are turned off. Some of the airflow zones 357 are only temporarily off in this state because of the current location of the inter-media zone 322, and these will be returned to the on state when the inter-media zone 322 has moved on. Others of the airflow zones 357, which are in the uncovered region 324, will remain off even when the inter-media zone 322 moves on.

As described above, in each airflow zone, a duct (such as the ducts 151 or 351) and a corresponding valve (such as the valves 152 or 352) controls airflow between the interior of the vacuum plenum and a corresponding group of holes in the vacuum platen, and in an off state of the airflow zone airflow between the plenum and the group of holes is blocked. In this context, "blocking" or "preventing" air from flowing from the interior of the vacuum plenum to the group of holes means that the ducts and valves create a relatively high impedance state for such airflow between the plenum and the holes, and thus significantly reduce such airflow, as compared to a completely open state (e.g., impedance is increased by at least tenfold and/or airflow is decreased by at least 90%). Thus, references herein to the an airflow zone being off and/or preventing airflow does not necessarily require a hermetic seal or the strict elimination of all airflow.

Although the embodiments of the airflow control systems 350 described above are illustrated and described in the context of the specific ink deposition assemblies 301 and media transport device 303 of the printing system 300, the same airflow control system 350 could be used in other embodiments of the printing system 300 having with differently configured ink deposition assemblies 301 and media transport devices 303. For example, the various embodiments of the airflow control systems 350 could be used in printing systems 300 with different types of movable support surfaces 320, printing systems 300 with different types of vacuum plenums 325, printing systems 300 with different types of vacuum platens 326, printing systems 300 with different numbers and/or types of printhead modules 302, and so on.

This description and the accompanying drawings that illustrate aspects and embodiments of the present disclosure should not be taken as limiting. The claims define the scope of protection. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding embodiments of the invention but is not intended to limit the invention. For example, spatially terms—such as "upstream", "downstream", "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to opposite sides of the media transport device along a cross-process direction. "Outboard" refers to the side of the media transport device closest to a registration location to which the edges of the print media are registered. "Inboard" refers to the side of the media transport device opposite from the outboard side. For example, in FIGS. 6A-6B the outboard side of the media transport device is labeled OB and the inboard side of the media transport device is labeled IB. By extension, the "outboard" edge of a print medium is the edge that is closest to the outboard edge of the media transport device, or in other words the edge that is used to register the print medium in the cross-process direction, while the inboard edge of a print medium is the opposite edge of the print medium. There is no limitation to which side of the media transport device the print media are registered, and different systems may register the media different. Thus, if a first side (e.g., the left side, when facing in the process direction) of the media transport device is the outboard side in one system, the first side (e.g., left side) in another system that uses a different registration scheme may be the inboard side, or vice versa. Furthermore, if a given system changes which side the print media are registered to (e.g., between print jobs), then the side of the device that is considered the "outboard" side will change accordingly. The terms "inboard" and "outboard" are also used to refer to cross-process directions, with "inboard" referring to a cross-process direction that points from the outboard side to the inboard side and "outboard" referring to the cross-process direction that points from the inboard side to the outboard side. In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context. Thus, for example, an "inboard side of a carrier plate" refers to a side of the carrier plate that is relatively further inboard than another side of the carrier plate.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

What is claimed is:

1. A printing system, comprising:

an ink deposition assembly comprising one or more printheads arranged to eject ink to a deposition region of the ink deposition assembly;

a media transport device comprising:

a vacuum platen comprising a plurality of platen holes arranged in columns extending in a process direction and rows extending in a cross-process direction, and a movable support surface configured to support a print medium and movable along a process direction through the deposition region, wherein the media transport device is configured to hold the print medium against the movable support surface by vacuum suction communicated to the movable support surface through the platen holes in the vacuum platen; and an airflow control system comprising a plurality of airflow zones, wherein:

each of the airflow zones comprises a group of the platen holes, a duct, and a valve, the duct and the valve being arranged to selectively control vacuum suction through the group of the platen holes, and for each of the printheads, at least one of the plurality of airflow zones is located under the respective printhead, and each group of platen holes consists of a subset of the holes from one or more of the rows and a subset of the holes from one or more columns.

2. The printing system of claim 1, wherein each of the plurality of airflow zones is selectively changeable between an on state and an off state, wherein in the on state of a given airflow zone of the plurality of airflow zones, the given airflow zone allows vacuum suction to be communicated to a corresponding group of the platen holes in the respective region of the vacuum platen, and wherein in the off state of the given airflow zone, the given airflow zone prevents vacuum suction from being communicated to the corresponding group of the platen holes in the respective region of the vacuum platen.

3. The printing system of claim 2, wherein the movable support surface is configured to support multiple print media and the airflow control system is configured to selectively change the airflow zones between the on state and the off state based on the location of an inter-media zone, the inter-media zone being between adjacent one of the print media held against the movable support surface.

4. The printing system of claim 3, wherein the airflow control system is configured place a given airflow zone in the off state in response to a downstream edge of the inter-media zone reaching a first position relative to the given airflow zone.

5. The printing system of claim 4, wherein the airflow control system is configured place the given airflow zone in the off state in response to an upstream edge of the inter-media zone reaching a second position relative to the given airflow zone.

6. The printing system of claim 5, wherein the first position corresponds to an upstream edge of given airflow zone and the second position corresponds to a downstream edge of the airflow zone.

7. The printing system of claim 2, wherein the airflow control system is configured to selectively place one or more of the airflow zones in the off state based on a size of a print medium to be held against the movable support surface.

8. The printing system of claim 7, wherein the one or more airflow zones that are placed in the off state comprise each airflow zone that is located inboard of a location aligned with an inboard edge of the print medium held against the movable support surface.

9. The printing system of claim 7, wherein the movable support surface is configured to support multiple print media and the airflow control system is configured to selectively change a subset of the airflow zones between the on state and the off state based on the location of an inter-media zone, the inter-media zone being between adjacent print media held against the movable support surface, the subset of the airflow zones comprising each of the airflow zones that are not placed in the off state based on the size of the print medium to be held against the movable support surface.

10. The printing system of claim 2, wherein at least some of the airflow zones that comprise platen holes in a same row are independently changeable between on and off states.

11. The printing system of claim 10, wherein the movable support surface comprises a belt.

12. The printing system of claim 10, wherein the one or more printheads comprises two printheads aligned with one another in a cross-process direction, and none of the airflow zones are disposed in a region between the two printheads.

13. The printing system of claim 2, wherein each of the respective valves of the plurality of airflow zones is actuatable between a closed state to place the airflow zone in the off state and an open state to place the airflow zone in the on state.

14. The printing system of claim 13, wherein at least some of the valves are coupled to a same drive shaft and actuated between the open and closed states together at the same timings by movement of the drive shaft.

15. The printing system of claim 14, wherein the airflow control system further comprises actuators operably coupled to the valves to actuate the valves between the open and closed states.

16. The printing system of claim 1, wherein the vacuum platen comprises a first surface, the movable support surface being movable over the first surface; and wherein the respective ducts of the plurality of airflow zones are positioned adjacent a second surface of the vacuum platen opposite to the first surface.

17. The printing system of claim 1, wherein the platen holes are arranged such that at least one of:

at least some of the holes in at least one of the rows are arranged with non-uniform spacings in the cross-process direction; or at least some of the holes in at least one of the columns are arranged with non-uniform spacings in the process direction.

18. The printing system of claim 1, wherein the platen holes are arranged such that at least one of:

at least one the rows comprises platen holes that are offset in the cross-process direction from the platen holes of an adjacent one of the rows; or at least one the columns comprises platen holes that are offset in the process direction from the platen holes of an adjacent one of the columns.

19. A method, comprising:

transporting a print medium through a deposition region of a printhead of a printing system, wherein the print medium is held during the transporting against a movable support surface of a media transport device via vacuum suction communicated to the movable support surface through platen holes in a vacuum platen, wherein the platen holes are arranged in columns extending in a process direction and rows extending in a cross-process direction, wherein the printing system comprises airflow zones that each comprise a corresponding group of the platen holes, and wherein each group of platen holes consists of a subset of the holes from one or more of the rows and a subset of the holes from one or more columns;

ejecting print fluid from the printhead to deposit the print fluid to the print medium in the deposition region;

selectively controlling suction through a first group of airflow zones, comprising one or more of the airflow zones, based on the size of the print medium; and selectively controlling suction through a second group of airflow zones, comprising one or more of the airflow zones, based on the size of the print medium.

20. The method of claim 19, wherein selectively controlling suction through the first group of airflow zones and selectively controlling suction through the second group of airflow zones comprises selectively actuating valves of the respective airflow zones.

21. The method of claim 19, wherein selectively controlling suction through the first group of airflow zones based on the size of the print medium comprises, selectively allowing and preventing suction through a given airflow zone of the first group based on a position of the print medium relative to the given airflow zone.

22. The method of claim 21, wherein selectively allowing and preventing suction through the given airflow zone based on a position of the print medium relative to the given airflow zone comprises:

preventing suction through the given airflow zone in response to a trail edge of the print medium reaching a first position relative to the given airflow zone; and allowing suction through the given airflow zone in response to a lead edge of the print medium reaching a second position relative to the given airflow zone.

23. The method of claim 21, wherein the first group and the second group comprise platen holes of a same row:

wherein selectively controlling suction through the second group of airflow zones based on the size of the print medium comprises selectively preventing suction through each of the airflow zones of the second group that will not be covered by the print medium as the print medium is transported through the deposition region while simultaneously selectively allowing suction through the given airflow zone of the first group.

24. The method of claim 19, wherein the first and second groups of airflow zones each comprise platen holes of a same row; and selectively controlling suction through the first and second groups of airflow zones comprises allowing suction through one or more of the airflow zones of the first group while simultaneously preventing suction through one or more of the airflow zones of the second group.

* * * * *